US010792921B2

(12) United States Patent
Sugiura

(10) Patent No.: US 10,792,921 B2
(45) Date of Patent: Oct. 6, 2020

(54) LIQUID JETTING HEAD AND LIQUID JETTING APPARATUS

(71) Applicant: Brother Kogyo Kabushiki Kaisha, Nagoya-shi, Aichi-ken (JP)

(72) Inventor: Keita Sugiura, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/170,123

(22) Filed: Oct. 25, 2018

(65) Prior Publication Data

US 2019/0263115 A1 Aug. 29, 2019

(30) Foreign Application Priority Data

Feb. 28, 2018 (JP) ..... 2018-034457

(51) Int. Cl.
*B41J 2/14* (2006.01)

(52) U.S. Cl.
CPC ..... *B41J 2/1433* (2013.01); *B41J 2/14233* (2013.01); *B41J 2202/12* (2013.01)

(58) Field of Classification Search
None
See application file for complete search history.

(56) References Cited

U.S. PATENT DOCUMENTS

| | | | | |
|---|---|---|---|---|
| 7,971,981 | B2 | 7/2011 | Nagashima et al. | |
| 8,449,077 | B2 | 5/2013 | Nishikawa | |
| 2008/0143793 | A1* | 6/2008 | Okuda | B41J 2/14233 347/68 |
| 2008/0238980 | A1 | 10/2008 | Nagashima et al. | |
| 2011/0316934 | A1 | 12/2011 | Nishikawa | |

FOREIGN PATENT DOCUMENTS

| | | | |
|---|---|---|---|
| JP | 2008-254196 | A | 10/2008 |
| JP | 2012-030582 | A | 2/2012 |

* cited by examiner

*Primary Examiner* — Erica S Lin
(74) *Attorney, Agent, or Firm* — Banner & Witcoff, Ltd.

(57) ABSTRACT

A liquid jetting head includes individual channels, a first common channel and a second common channel being return channels for returning liquid from the individual channels to a storage chamber for storing the liquid, and a third common channel being a supply channel for supplying the liquid from the storage chamber to the individual channels. The first to third common channels are arranged in an arrangement direction. The third common channel is arranged between the first and second common channels in the arrangement direction and extends in an extending direction. The individual channels include: first individual channels which connect the first common channel and the third common channel; and second individual channels which connect the second common channel and the third common channel, and each of the individual channels has a nozzle, and a communicating channel that runs directly above the nozzle.

19 Claims, 13 Drawing Sheets

LIQUID JETTING HEAD AND LIQUID JETTING APPARATUS

CROSS REFERENCE TO RELATED APPLICATION

The present application claims priority from Japanese Patent Application No. 2018-034457, filed on Feb. 28, 2018, the disclosure of which is incorporated herein by reference in its entirety.

BACKGROUND

Field of the Invention

The present invention relates to a liquid jetting head provided with common channels including a supply channel and a return channel, and a liquid jetting apparatus provided with the liquid jetting head.

Description of the Related Art

A liquid jetting head in which common supply channels (supply channels) and common recovery channels (return channels) are arranged alternately in an arrangement direction has been known. In such a liquid jetting head, individual channels are provided between the supply channel and the return channel that are mutually adjacent in the arrangement direction such that the supply channel and the return channel are connected by the individual channels. Each of the individual channels has one nozzle, and one communicating channel which passes directly above the one nozzle.

SUMMARY

In the liquid jetting head, both the individual channels (first individual channels) provided on one side in the arrangement direction of one of the supply channel and the return channel and the individual channels (second individual channels) provided on the other side in the arrangement direction of the one of the supply channel and the return channel are extended in a fixed direction inclined with respect to an extending direction of the supply channels and the return channels. In other words, a communicating direction, of a certain first individual channel, in which the communicating channel is extended from the one of the supply channel and the return channel is inclined with respect to the extending direction, and has a vector toward one side in the extending direction. On the other hand, a communicating direction, of a certain second individual channel, in which the communicating channel is extended from the one of the supply channel and the return channel is inclined with respect to the extending direction, and has a vector toward the other side in the extending direction, the certain second individual channel including a nozzle which is adjacent to a nozzle included in the certain first individual channel in relation to the extending direction. In this case, when liquid flows from the supply channel toward the return channel through the individual channels, a force toward the one side in the extending direction acts on the liquid jetted from the nozzle of the certain first individual channel due to the flow of the liquid running through the communicating channel. On the other hand, a force toward the other side in the extending direction acts on the liquid jetted from the nozzle of the certain second individual channel. In other words, forces toward opposite sides in the extending directions act on the liquids jetted from the two nozzles adjacent in the extending direction, respectively. Accordingly, liquids jetted from the two nozzles fly toward opposite sides in the extending direction, and land at positions shifted in the one side in the extending direction and the other side in the extending direction with respect to desired positions. Therefore, such an arrangement of the liquid jetting head causes sparseness and density of dots in the extending direction.

An object of the present teaching is to provide a liquid jetting head and a liquid jetting apparatus in which it is possible to suppress the sparseness and density of dots in the extending direction.

According to a first aspect of the present teaching, there is provided a liquid jetting head including: individual channels; a first common channel and a second common channel being return channels through which liquid is returned from the individual channels to a storage chamber configured to store the liquid; and a third common channel being a supply channel through which the liquid is supplied from the storage chamber to the individual channels, wherein the first common channel, the second common channel, and the third common channel are arranged in an arrangement direction, the third common channel is arranged between the first common channel and the second common channel in the arrangement direction, and is extended in an extending direction orthogonal to the arrangement direction, the individual channels include: first individual channels which connect the first common channel and the third common channel; and second individual channels which connect the second common channel and the third common channel, each of the individual channels includes a nozzle and a communicating channel, the communicating channel running directly above the nozzle and being extended in a communicating direction from the third common channel, the communicating direction of a certain first individual channel included in the first individual channels and the communicating direction of a certain second individual channel included in the second individual channels are both inclined with respect to the extending direction, and have vectors toward one side in the extending direction, and the nozzle in the certain first individual channel and the nozzle in the certain second individual channel are adjacent to one another in relation to the extending direction.

According to a second aspect of the present teaching, there is provided a liquid jetting head including: individual channels: a first common channel and a second common channel being supply channels through which liquid is supplied to the individual channels from a storage chamber configured to store the liquid; and a third common channel being a return channel through which the liquid is returned from the individual channels to the storage chamber, wherein the first common channel, the second common channel, and the third common channel are arranged in an arrangement direction, the third common channel is arranged between the first common channel and the second common channel in the arrangement direction, and is extended in an extending direction orthogonal to the arrangement direction, the individual channels include: first individual channels which connect the first common channel and the third common channel; and second individual channels which connect the second common channel and the third common channel, each of the individual channels has a nozzle, and a communicating channel, the communicating channel running directly above the nozzle and being extended in a communicating direction from the third common channel, the communicating direction of a certain first individual channel included in the first individual channels and the communicating direction of a certain second individual channel included in the second individual channels are both inclined with respect to the extending direction, and have vectors toward one side in the extending direction, and the nozzle in the certain first individual channel and the nozzle in the certain second individual channel are adjacent to one another in relation to the extending direction.

According to a third aspect of the present teaching, there is provided a liquid jetting head including: individual channels: a first common channel set including: a supply channel through which liquid is supplied from a storage chamber configured to store the liquid to the individual channels: and a return channel through which the liquid is returned from the individual channels to the storage chamber; and a second common channel set including the supply channel and the return channel, wherein the first common channel set and the second common channel set are arranged in an arrangement direction, in each of the first common channel set and the second common channel set, the supply channel and the return channel are arranged in the arrangement direction, and each of the supply channel and the return channel is extended in an extending direction, the individual channels include: first individual channels which connect the supply channel and the return channel of the first common channel set; and second individual channels which connect the supply channel and the return channel of the second common channel set, and each of the individual channels includes a nozzle and a communicating channel, the communicating channel running directly above the nozzle and being extended in a communicating direction from the supply channel to the return channel, the communicating direction of a certain first individual channel included in the first individual channels and the communicating direction of a certain second individual channel included in the second individual channels are both inclined with respect to the extending direction, and have vectors toward one side in the extending direction, and the nozzle in the certain first individual channel and the nozzle in the certain second individual channel are adjacent to one another in relation to the extending direction.

According to a fourth aspect of the present teaching, there is provided a liquid jetting apparatus including: a liquid jetting head: and a controller, wherein the liquid jetting head includes: individual channels each including a nozzle, a communicating channel running directly above the nozzle, and at least one pressure chamber which communicates with the nozzle; actuators each facing the pressure chamber of one of the individual channels; a first common channel and a second common channel being return channels through which liquid is returned from the individual channels to a storage chamber configured to store the liquid; and a third common channel being a supply channel through which the liquid is supplied from the storage chamber to the individual channels, the first common channel, the second common channel, and the third common channel are arranged in an arrangement direction, the third common channel is arranged between the first common channel and the second common channel in the arrangement direction, and is extended in an extending direction orthogonal to the arrangement direction, the individual channels include: first individual channels which connect the first common channel and the third common channel; and second individual channels which connect the second common channel and the third common channel, the communicating channel of each of the individual channels is extended in a communicating direction from the third common channel, the communicating direction of a certain first individual channel included in the first individual channels and the communicating direction of a certain second individual channel included in the second individual channels are both inclined with respect to the extending direction, and have vectors toward one side in the extending direction, and the nozzle in the certain first individual channel and the nozzle in the certain second individual channel are adjacent to one another in relation to the extending direction, the first individual channels are positioned upstream of the third common channel in a relative movement direction of a jetting target relative to the liquid jetting head, the second individual channels are positioned downstream of the third common channel in the relative movement direction, the actuators include: first actuators each facing the pressure chamber of one of the first individual channels; and second actuators each facing the pressure chamber of one of the second individual channels, and the controller is configured to: drive the first actuators before a specified timing, the specified timing being a timing at which the actuators are driven in a case that the communicating direction is parallel to the extending direction; and drive the second actuators after the specified timing.

DESCRIPTION OF THE EMBODIMENTS

First Embodiment

Figure 1:
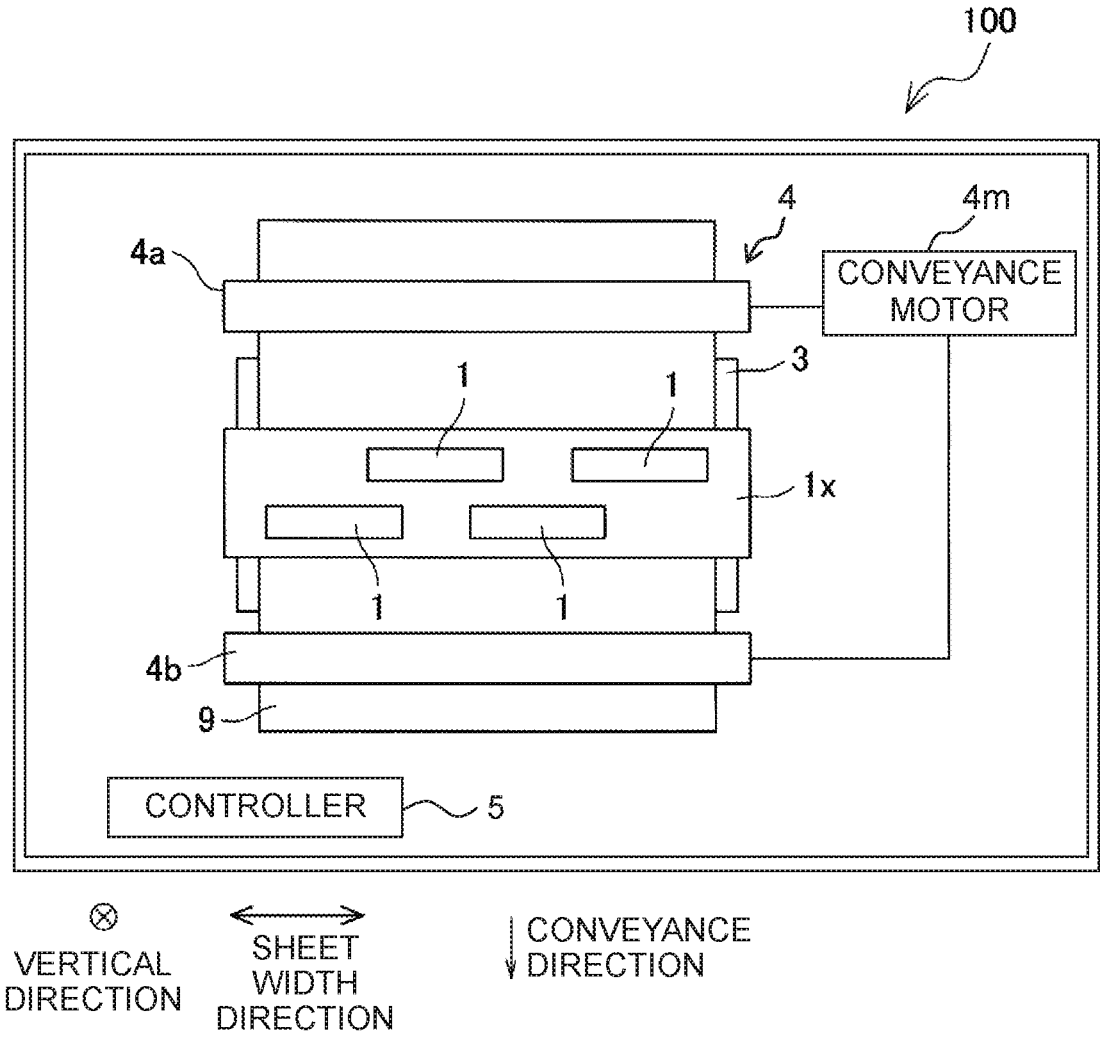
FIG. 1 is a plan view of a printer having a head according to a first embodiment of the present teaching.

To start with, an overall configuration of a printer 100 which includes a head 1 according to a first embodiment of the present teaching will be described below by referring to FIG. 1.

The printer 100 includes a head unit 1*x* which includes four heads 1, a platen 3, a conveyance mechanism 4, and a controller 5.

A paper 9 is placed on an upper surface of the platen 3.

The conveyance mechanism 4 has two pairs of rollers 4*a* and 4*b* arranged to sandwich the platen 3 in a conveyance direction. As a transporting motor 4*m* is driven by a control of the controller 5, the pairs of rollers 4*a* and 4*b* rotate in a state of pinching the paper 9, and the paper 9 is transported in the conveyance direction.

The head unit 1*x* is of a line type (a type in which ink is jetted onto the paper from nozzles 21 in a state that a position of the head unit 1*x* is fixed (refer to FIG. 2 and FIG. 3)), with a long side in a paper width direction. The four heads 1 are arranged in zigzag form in the paper width direction.

Here, the paper width direction is orthogonal to the conveyance direction. Both the paper width direction and the conveyance direction are orthogonal to a vertical direction.

The controller 5 includes a ROM (Read Only Memory), a RAM (Random Access Memory), and an ASIC (Application Specific Integrated Circuit). The ASIC executes recording processing in accordance with a computer program stored in the ROM. In the recording processing, the controller 5 controls a driver IC 1*d* of each head 1 (refer to FIG. 3 and FIG. 4) and the transporting motor 4*m* on the basis of a recording command (including image data) that has been input from an external apparatus such as a PC (personal computer), and records an image on the paper 9.

Next, an arrangement the head 1 will be described by referring to FIG. 2 and FIG. 3.

The head 1 includes a channel substrate 11 and an actuator unit 12.

Figure 3:
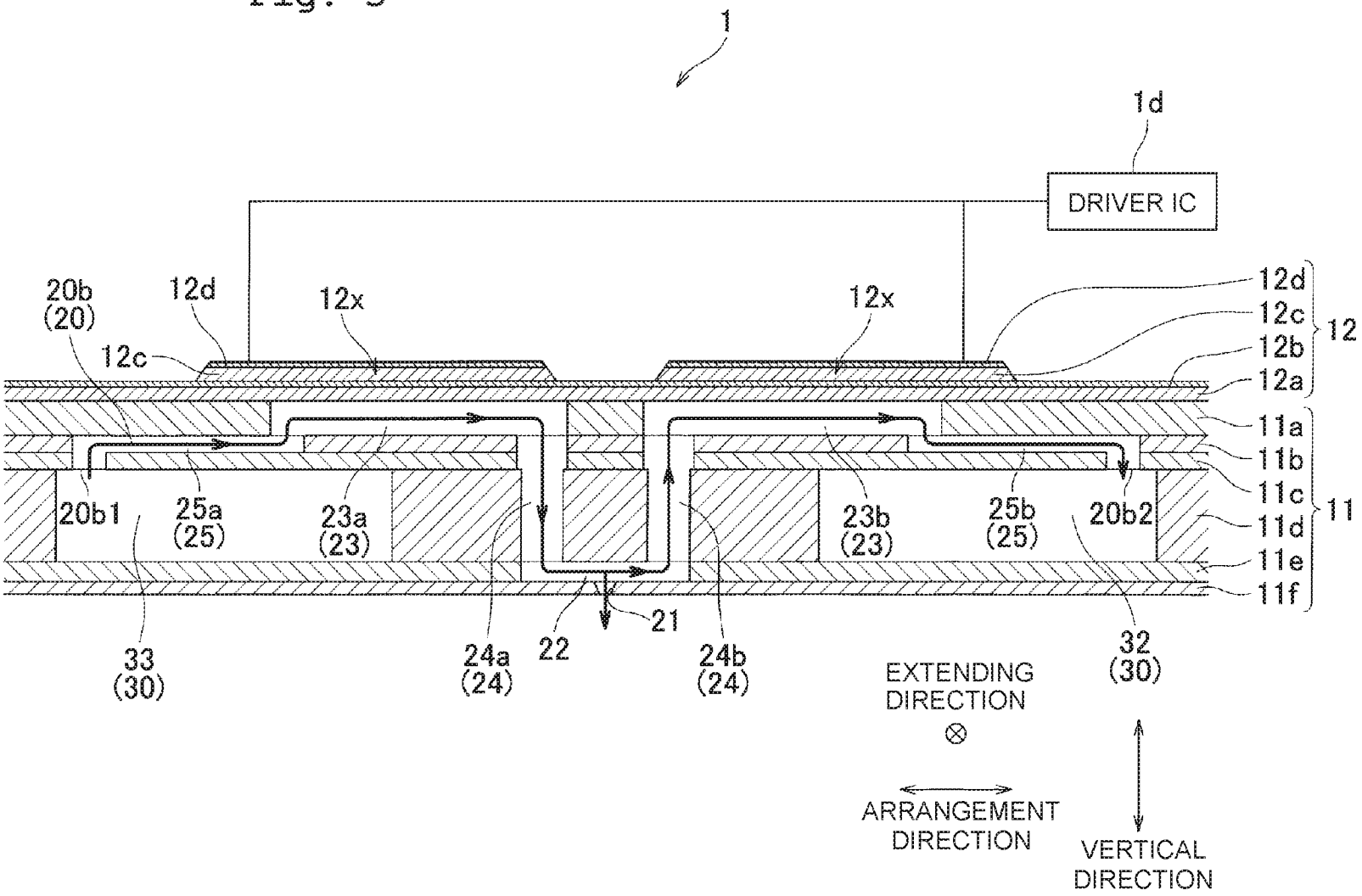
FIG. 3 is a cross-sectional view of the head along a line III-III in FIG. 2.
Figure 4:
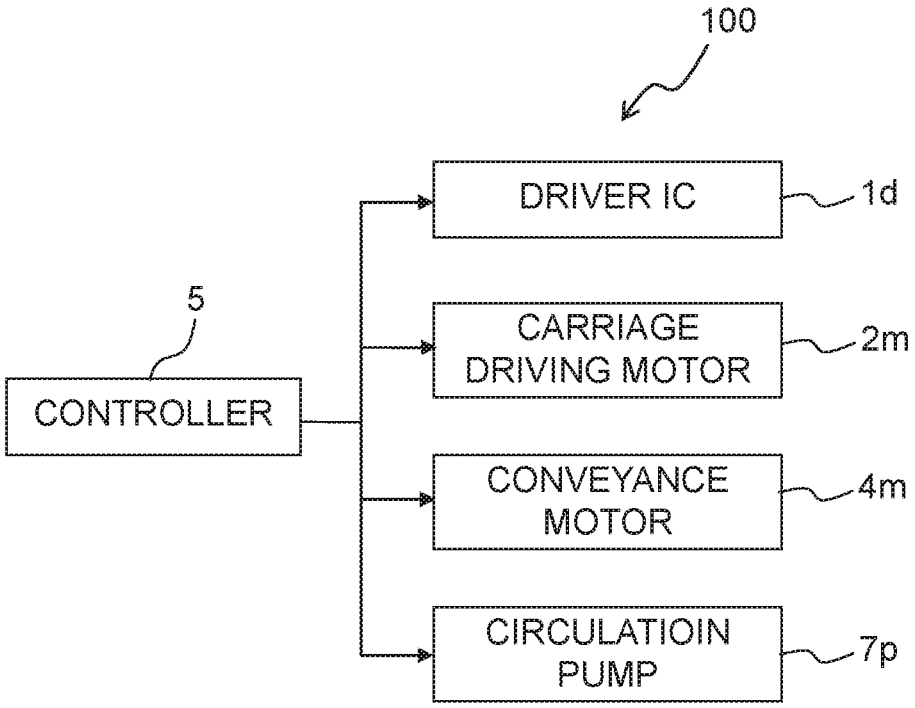
FIG. 4 is a block diagram depicting an electrical configuration of the printer.

The channel substrate 11, as depicted in FIG. 3, has six plates 11*a*, 11 *b*, 11*c*, 11*d*, 11*e*, and 11*f* (hereinafter, referred to as plates 11*a* to 11*f*) adhered to one another. A common channel 30 is formed in the plate 11*d*. Individual channels 20 which communicate with the common channel 30 are formed in the plates 11*a* to 11*f*.

Figure 2:
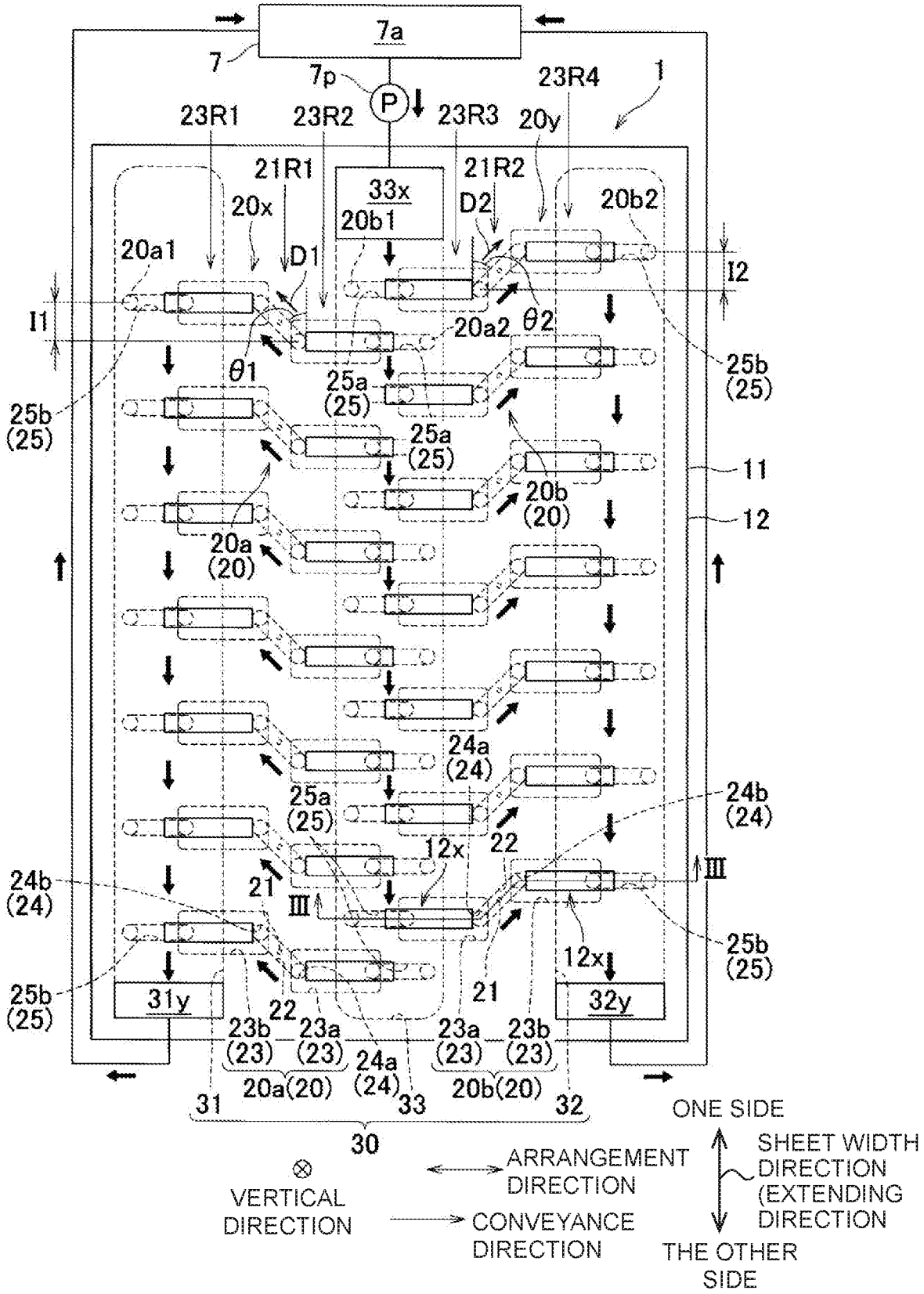
FIG. 2 is a plan view of the head.

The common channel 30, as depicted in FIG. 2, includes return channels 31 and 32 arranged in an arrangement direction (direction parallel to the conveyance direction), and a supply channel 33. Each of the return channels 31 and 32, and the supply channel 33 is extended in an extending direction (direction parallel to the paper width direction). The supply channel 33 is arranged between the return channel 31 and the return channel 32 in the arrangement direction.

The supply channel 33 communicates with a storage chamber 7*a* of a sub tank 7 via a supply port 33*x*. The return channels 31 and 32 communicate with the storage chamber 7*a* via discharge ports 31*y* and 32*y* respectively. The supply port 33*x* is formed at one end portion (upper side in FIG. 2) in the extending direction, of the supply channel 33. The discharge ports 31*y* and 32*y* are formed at the other end portions of (lower side in FIG. 2) in the extending direction, of the return channels 31 and 32.

The sub tank 7 is mounted together with the head 1 on the carriage 2. The storage chamber 7*a* communicates with a main tank (omitted in the diagram) that stores an ink, and stores the ink supplied from the main tank.

The individual channels 20 include first individual channels 20*a* which connect the return channel 31 and the supply channel 33 and second individual channels 20*b* which connect the return channel 32 and the supply channel 33. Each first individual channel 20*a* is spread over the return channel 31 and the supply channel 33 in the arrangement direction. Each second individual channel 20*b* is spread over the return channel 32 and the supply channel 33 in the arrangement direction.

Here, a length in the arrangement direction of the supply port 33*x* and the discharge ports 31*y* and 32*y* is mutually same, and a length in the extending direction of each of the discharge ports 31*y* and 32*y* is half the length in the extending direction of the supply port 33*x*. In other words, an area of each of the discharge ports 31*y* and 32*y* is half an area of the supply port 33*x*. Such arrangement is made upon taking into consideration the fact that the number of individual channels 20 connected to each of the return channels 31 and 32 is half the number of individual channels 20 connected to the supply channel 33 and the fact that an amount of ink that flows through each of the return channels 31 and 32 is half an amount of ink that flows through the supply channel 33.

Thick arrow marks in FIG. 2 and arrow marks in FIG. 3 depict a flow of ink.

As depicted in FIG. 2, the ink in the storage chamber 7*a* is supplied to the supply channel 33 through the supply port 33*x* by a circulation pump 7*p* being driven by a control of the controller 5. The ink supplied to the supply channel 33, while moving inside the supply channel 33 from one side to the other side in the extending direction, is supplied to each of the first individual channels 20*a* and the second individual channels 20*b*. The ink supplied to the first individual channel 20*a* flows into the return channel 31 and moves inside the return channel 31 from the one side to the other side in the extending direction. Moreover, the ink flowed into the return channel 31 is discharged from the return channel 31 via the discharge port 31*y* and is returned to the storage chamber 7*a*. The ink supplied to the second individual channel 20*b* flows into the return channel 32 and moves inside the return channel 32 from the one side to the other side in the extending direction. Moreover, the ink flowed into the return channel 32 is discharged from the return channel 32 via the discharge port 32*y* and is returned to the storage chamber 7*a*. By circulating the ink between the head 1 and the sub tank 7 in such manner, removal of air bubbles inside the ink and prevention of thickening of ink are realized.

Each individual channel 20 includes a nozzle 21, a communicating channel 22, two pressure chambers 23, two connecting channels 24, and two joining channels 25. As depicted in FIG. 2, the nozzle 21 is a through hole formed in the plate 11*f*. The communicating channel 22 is a channel running directly above the nozzle 21, and is a through hole formed in the plate 11*e*. The communicating channel 22 being a channel running directly above the nozzle 21, a flow of ink at an interior thereof has an effect on a direction in which the ink is jetted from the nozzle 21. The pressure chamber 23 is a through hole formed in the plate 11*a*. The connecting channel 24 is a through hole formed in the plates 11*b* to 11*d*, and is extended in the vertical direction. The joining channel 25 is a through hole formed in the plates 11*b* and 11*c*.

The pressure chamber 23, the connecting channel 24, and the joining channel 25 are divided into (classified as) a first pressure chamber 23*a*, a first connecting channel 24, and a first joining channel 25*a*, and a second pressure chamber 23*b*, a second connecting channel 24*b*, and a second joining channel 25*b*. The first pressure chamber 23*a*, the first connecting channel 24*a*, and the first joining channel 25*a*, and the second pressure chamber 23*b*, the second connecting channel 24*b*, and the second joining channel 25*b* sandwich the nozzle 21 in the arrangement direction. The first pressure chamber 23*a*, the first connecting channel 24*a*, and the first joining channel 25*a* are at positions nearer from the supply channel 33 than the nozzle 21 in the arrangement direction, or at positions overlapping with the supply channel 33 in the vertical direction. The second pressure chamber 23*b*, the second connecting channel 24*b*, and the second joining channel 25*b* are at positions farther from the supply channel 33 than the nozzle 21 in the arrangement direction. A portion of the first pressure chamber 23*a* and the first joining channel 25*a* overlap with the supply channel 33 in the vertical direction. A portion of the second pressure chamber 23*b* and the second joining channel 25*b* overlap with the return channel 31 or the return channel 32 in the vertical direction.

The first pressure chamber 23*a* communicates with the nozzle 21 via the first connecting channel 24*a* and the communicating channel 22. The second pressure chamber 23*b* communicates with the nozzle 21 via the second connecting channel 24*b* and the communicating channel 22. The first pressure chamber 23*a* and the second pressure chamber 23*b* communicate mutually via the first connecting channel 24*a*, the communicating channel 22, and the second connecting channel 24*b*. The first connecting channel 24*a* connects one end of the first pressure chamber 23*a*, nearer to the nozzle 21 in the arrangement direction and one end of the communicating channel 22 nearer to the supply channel 33 in the arrangement direction. The second connecting channel 24*b* connects one end of the second pressure chamber 23*b* nearer to the nozzle 21 in the arrangement direction and the other end in the arrangement direction of the communicating channel 22. The first joining channel 25*a* joins the supply channel 33 and the other end in the arrangement direction of the first pressure chamber 23*a*. The second joining channel 25*b* joins the return channel 31 or the return channel 32 and the other end in the arrangement direction of the pressure chamber 23*b*.

The ink supplied to each individual channel 20 moves substantially horizontally running through the first joining channel 25*a* and the first pressure chamber 23*a*, further moving downward through the first connecting channel 24*a*, and flows into the communicating channel 22. The ink flowed into the communicating channel 22 moves horizontally through the communicating channel 22, and after a part thereof being jetted through the nozzle 21, the remaining ink moves upward through the second connecting channel 24*b*, and moves substantially horizontally through the second pressure chamber 23*b* and the second joining channel 25*b*, and flows into the return channel 31 or the return channel 32.

The pressure chambers 23 open on an upper surface of the channel substrate 11 (an upper surface of the plate 11*a*) as depicted in FIG. 2. The pressure chambers 23 form four pressure chamber rows 23R1, 23R2, 23R3, and 23R4 (hereinafter, pressure chamber rows 23R1 to 23R4). The four pressure chamber rows 23R1 to 23R4 are extended in the extending direction and are arranged in the arrangement direction. Out of the four pressure chamber rows 23R1 to 23R4, the two pressure chamber rows 23R1 and 23R2 on a left side in FIG. 2 are formed by first pressure chambers 23*a* and second pressure chambers 23*b* of the first individual channels 20*a*. Out of the four pressure chamber rows 23R1 to 23R4, the two pressure chamber rows 23R3 and 23R4 on a right side in FIG. 2 are formed by first pressure chambers 23*a* and second pressure chambers 23*b* of the second individual channels 20*b*. In each of the pressure chamber rows 23R1 to 23R4, the pressure chambers 23 are arranged at same positions in the arrangement direction, and at a same interval in the extending direction. Whereas, between the pressure chamber rows 23R1 to 23R4, positions of the pressure chambers 23 in the extending direction are misaligned. Accordingly, for all the pressure chambers 23, positions in the extending direction differ from positions of the pressure chambers 23 other than the abovementioned pressure chambers 23.

The nozzles 21 open on a lower surface of the channel substrate 11 (a lower surface of the plate 11*f*). The nozzles 21 form two nozzle rows 21R1 and 21R2 extended in the extending direction and arranged in the arrangement direction. Out of the two nozzle rows 21R1 and 21R2, the nozzle row 21R1 on the left side in FIG. 2 is formed by the nozzles 21 of the first individual channels 20*a* and is sandwiched between the pressure chamber rows 23R1 and 23R2 in the arrangement direction. Out of the two nozzle rows 21R1 and 21R2, the nozzle row 21R2 on the right side in FIG. 2 is formed by the nozzles 21 of the second individual channels 20*b* and is sandwiched between the pressure chamber rows 23R3 and 23R4 in the arrangement direction. In the nozzle rows 21R1 and 21R2, the nozzles 21 are arranged at same positions in the arrangement direction and at an equal interval in the extending direction. Whereas, between the nozzle rows 21R1 and 21R2, positions of the nozzles in the extending direction are shifted. Accordingly, for all the nozzles 21, positions in the extending direction differ from positions of the nozzles 21 other than the abovementioned nozzles 21.

Here, let the first individual channel 20*a* at the uppermost side of the first individual channels 20*a* in FIG. 2 be a certain first individual channel 20*x* and let the second individual channel 20*b* at the uppermost side of the second individual channels 20*b* in FIG. 2 be a certain second individual channel 20*y*. The nozzle 21 in the first individual channel 20*x* and the nozzle 21 in the second individual channel 20*y* are mutually adjacent in the extending direction (in other words, no other nozzle 21 is arranged between the nozzle 21 in the first individual channel 20*x* and the nozzle 21 in the second individual channel 20*y*). The communicating channel 22 of the first individual channel 20*x* and the communicating channel 22 of the second individual channel 20) are both extended from the supply channel 33 in a direction inclined with respect to the extending direction (a direction intersecting with the extending direction and the arrangement direction). In other words, a communicating direction D1 of the first individual channel 20*x* (direction in which the communicating channel 22 is extended from the supply channel 33) and a communicating direction D2 of the second individual channel 20*y* are both inclined with respect to the extending direction. The communicating directions D1 and D2 are mutually opposite in the arrangement direction, and have vectors toward the one side in the extending direction.

In the present embodiment, the communicating channels 22 of all the first individual channels 20*a* are extended in the mutually same direction (communicating direction D1) from the supply channel 33. The communicating channels 22 of all the second individual channels 20*b* are extended in the mutually same direction (communicating direction D2) from the supply channel 33.

An acute angle θ1 between the communicating direction D1 and the extending direction and an acute angle θ2 between the communicating direction D2 and the extending direction are mutually equal and less than 60 degrees (approximately 45 degrees).

For all the first individual channels 20*a*, an interval I1 in the extending direction between one end 20*a*1 connected to the return channel 31 and the other end 20*a*2 connected to the supply channel 33 is same. For all the second individual channels 20*b*, an interval I2 in the extending direction between one end 20*b*1 connected to the supply channel 33 and the other end 20*b*2 connected to the return channel 32 is same. The interval I1 and the interval I2 are mutually equal. The one end 20*a*1 corresponds to an end portion of the first individual channel 20*a*, on an opposite side of the second pressure chamber 23*b* in (of) the second joining channel 25*b*. The other end 20*a*2 corresponds to an end portion of the first individual channel 20*a*, on an opposite side of the first pressure chamber 23*a* in (of) the first joining channel 25*a*. The one end 20*b*1 corresponds to an end portion of the second individual channel 20*b*, on an opposite side of the first pressure chamber 23*a* in (of) the first joining channel 25*a*. The other end 20*b*2 corresponds to an end portion of the second individual channel 20*b*, on an opposite side of the second pressure chamber 23*b* in (of) the second joining channel 25*b* (refer to FIG. 3).

In each individual channel 20, the nozzles 21 are arranged in the middle (at a center) in the communicating directions D1 and D1 of the communicating channel 22.

The actuator unit 12 is arranged on the upper surface of the channel substrate 11, and covers the pressure chambers 23.

The actuator unit 12, as depicted in FIG. 3, includes in order from below, a vibration plate 12*a*, a common electrode 12*b*, piezoelectric bodies 12*c*, and individual electrodes 12*d*. The vibration plate 12*a* and the common electrode 12*b* are arranged on nearly the entire upper surface of the channel substrate 11 and cover the pressure chambers 23. Whereas, the piezoelectric bodies 12*c* and the individual electrodes 12*d* are provided to each pressure chamber 23 and are facing (are opposite to) the respective pressure chambers 23.

In the common electrode 12*b*, the vibration plate 12*a*, and the plates 11*a* to 11*c*, through holes are formed at positions corresponding to the supply port 33*x*, and the discharge ports 31*y* and 32*y* (refer to FIG. 2). The supply port 33*x* and the discharge ports 31*y* and 32*y* open on an upper surface of the head 1, and communicate with the supply channel 33 and the return channels 31 and 32 via the through holes.

The individual electrodes 12*d* and the common electrode 12*b* are electrically connected to the driver IC 1*d*. The driver IC 1*d* maintains an electric potential of the common electrode 12*b* to a ground electric potential and changes an electric potential of the individual electrode 12*d*. More specifically, the driver IC 1*d* generates a drive signal on the basis of a control signal from the controller 5, and applies the drive signal generated to the individual electrode 12*d*. Accordingly, the electric potential of the individual electrode 12*d* varies between a predetermined drive electric potential and the ground electric potential. At this time, a volume of the pressure chamber 23 changes such that a portion of the vibration plate 12*a* and the piezoelectric body 12*c* sandwiched between the individual electrode 12*d* and the pressure chamber 23 (an actuator 12*x*) is deformed to form a projection toward the pressure chamber 23, and a pressure is applied to an ink in the pressure chamber 23 and the ink is jetted through the nozzle 21.

The actuator unit 12 has actuators 12*x* facing (opposite to) the pressure chambers 23 respectively. In the present embodiment, in (for) each individual channel 20, it is possible to increase a velocity of flying of ink jetted from the nozzles 21 by driving the actuators 12*x* facing the two pressure chambers 23 simultaneously.

In the present embodiment, as mentioned above, the communicating directions D1 and D2 have vectors toward the same side in the extending direction (the one side in the extending direction, refer to FIG. 2). Therefore, in each individual channel 20, when the ink flows from the supply channel 33 toward the return channel 31 through the individual channel 20, by the flow of the ink through the communicating channel 22, a force toward the one side in the extending direction acts on the ink jetted through the nozzle 21. Accordingly, the ink jetted from the nozzle 21 flies toward the same side in the extending direction (the one side in the extending direction), and lands at a position shifted in the one side in the extending direction with respect to the desired position. In this case, although the landing position of the ink is shifted, since the landing positions of the inks jetted from all the nozzles 21 of the head 1 are shifted in the mutually same direction, sparseness and density of dots in the extending direction are suppressed.

On the other hand, the communicating directions D1 and D2 have vectors toward opposite sides in the arrangement direction. Therefore, when the ink flows from the supply channel 33 toward the return channels 31 and 32 via the individual channels 20, by the flow of the ink passing through the communicating channel 22, forces in mutually opposite direction in the arrangement direction act on the ink that is jetted from the nozzles 21 of the first individual channel 20*a* and the ink that is jetted from the nozzles 21 of the second individual channel 20*b*. More specifically, a force in a direction directed from the supply channel 33 to the return channel 31 (leftward direction in FIG. 2) acts on the ink that is jetted from the nozzles 21 of the first individual channel 20*a*. A force in a direction directed from the supply channel 33 toward the return channel 32 (rightward direction in FIG. 2) acts on the ink jetted from the nozzle 21 of the second individual channel 20*b*. Consequently, in a case of not taking any measures, the ink jetted from the nozzle 21 of the first individual channel 20*a* and the ink jetted from the nozzle 21 of the second individual channel 20*b* fly in mutually opposite direction in the arrangement direction, and lands at positions shifted to one and the other of the arrangement direction respectively, with respect to the desired positions.

Therefore, the controller 5 drives the actuator 12*x* belonging to the first individual channel 20*a* before a specified timing, and drives the actuator 12*x* belonging to the second individual channel 20*b* after the specified timing. The specified timing is a timing of driving the actuator 12*x* in a case where the communicating directions D1 and D2 are parallel to the extending direction. In the case where the communicating directions D1 and D2 are parallel to the extending direction, there is no shift in the landing position of ink in the arrangement direction with respect to the desired position.

In the present embodiment, the head 1 is of line type, and the first individual channel 20*a* is positioned at an upstream of the conveyance direction with respect to the supply channel 33 (in other words, an upstream in relative movement direction of the paper 9 relative to the head 1), and the second individual channel 20*b* is positioned at a downstream of the conveyance direction with respect to the supply channel 33 (downstream in the relative movement direction). In a case where the actuator 12*x* belonging to the first individual channel 20*a* is driven at the specified timing, the ink jetted from the nozzles 21 of the first individual channel 20*a* flies upstream of the conveyance direction due to an effect of the flow of ink directed from the supply channel 33 toward the return channel 31 through the first individual channel 20*a*, and lands at an upstream of the conveyance direction with respect to the desired position. In the present embodiment, by driving the actuator I2*x* belonging to the first individual channel 20*a* before the specified timing, the landing position of the ink jetted from the nozzles 21 of the first individual channel 20*a* is corrected to downstream of the conveyance direction. In a case where the actuator 12*x* belonging to the second individual channel 20*b* is driven at the specified timing, the ink jetted from the nozzles 21 of the second individual channel 20*b* flies downstream in the conveyance direction due to an effect of the flow of ink directed from the supply channel 33 toward the return channel 32 through the second individual channel 20*b*, and lands at a downstream of the conveyance direction with respect to the desired position. In the present embodiment, by driving the actuator 12*x* belonging to the second individual channel 20*b* after the specified timing, the landing position of the ink jetted from the nozzles 21 of the second individual channel 20*b* is corrected to upstream of the conveyance direction.

As mentioned heretofore, according to the present embodiment, both the communicating direction D1 of the first individual channel 20*x* and the communicating direction D2 of the second individual channel 20*y* are inclined with respect to the extending direction, and have vectors toward the one side in the extending direction (upward direction in FIG. 2). Therefore, it is possible to suppress dots from being (distributed unevenly to be) sparse and dense in the extending direction.

The communicating direction D1 for each of the first individual channels 20*a* and the communicating direction D2 for each of the second individual channels 20*b* are both inclined with respect to the extending direction, and have vectors toward the one side in the extending direction (upward direction in FIG. 2). In this case, there is an empty space developed in the one side in the extending direction of the supply channel 33 and the other side in the extending direction of the return channels 31 and 32. By providing the supply port 33*x* and the discharge ports 31*y* and 32*y* in the space and making an effective use of the space, it is possible to make size of the head 1 small in the extending direction.

The interval I1 in the first individual channel 20*a* and the interval I2 in the second individual channel 20*b* are mutually equal. Accordingly, a difference in a flow rate of the ink flowing through the communicating channel 22 between the first individual channel 20*a* and the second individual channel 20*b* is suppressed, and it is possible to suppress a variation in an amount of ink jetted and velocity of flying of ink. Here, "the intervals I1 and I2 are mutually equal" means a case in which there is a difference in the intervals I1 and I2 but the difference is minute (not more than 5% of an average value of intervals I1 and I2) in addition to a case in which there is no difference in the intervals I1 and I2.

The nozzles 21 are arranged in the middle (at a center) of the communicating directions D1 and D2 of the communicating channel 22. In this case, particularly, a direction in which the ink jetted from the nozzles 21 flies is susceptible to have an effect of the flow of ink passing through the communicating channel 22. Consequently, the problem of the dots becoming sparse and dense in the extending direction may become remarkable. In view of this point, since the present embodiment can suppress the dots from becoming sparse and dense in the extending direction by fulfilling the condition that the communicating directions D1 and D2 are inclined with respect to the extending direction and have vectors toward the one side in the extending direction, it is particularly effective with such arrangement.

Each individual channel 20 has two pressure chambers 23. In this case, for each individual channel 20, by driving simultaneously the two actuators 12*x* corresponding to the two pressure chambers 23, it is possible to increase the velocity of flying of ink jetted from the nozzles 21.

Both the acute angle θ1 between the communicating direction D1 of the first individual channel 20*x* and the extending direction and the acute angle θ2 between the communication direction D2 of the second individual channel 20*y* and the extending direction are less than 60 degrees. In this case, the vectors in the extending direction of the communicating directions D1 and D2 become comparatively large, and sparseness and density of dots in the extending direction may be caused easily. In view of this point, since the present embodiment can suppress the sparseness and density of dots in the extending direction by fulfilling the condition that the communicating directions D1 and D2 are inclined with respect to the extending direction and have vectors toward the one side in the extending direction, it is particularly effective with such arrangement.

The angle θ1 and θ2 are mutually equal. In this case, when the ink flows from the supply channel 33 toward the return channels 31 and 32 through the individual channel 20, due to the flow of the ink passing through the communicating channel 22, forces acting on the ink that is jetted from the nozzle 21 become equal in the first individual channel 20*x* and the second individual channel 20*y*. Accordingly, it is possible to suppress more assuredly the sparseness and density of dots in the extending direction. Here, "the angles θ1 and θ2 are mutually equal" means a case in which there is a difference in the angles θ1 and θ2 but the difference is minute (not more than 5% of an average value of the angles θ1 and θ2) in addition to a case in which there is no difference in the angles θ1 and θ2.

The controller 5 drives the actuator 12*x* belonging to the first individual channel 20*a* before the specified timing of a case in which the communicating directions D1 and D2 are parallel to the extending direction, and drives the actuator 12*x* belonging to the second individual channel 20*b* after the specified timing. In this case, it is possible to suppress the dots from becoming sparse and dense in the extending direction by the arrangement of the individual channel 20, and also to suppress the dots from becoming sparse and dense in the arrangement direction by the control of the controller 5.

Second Embodiment

Figure 5:
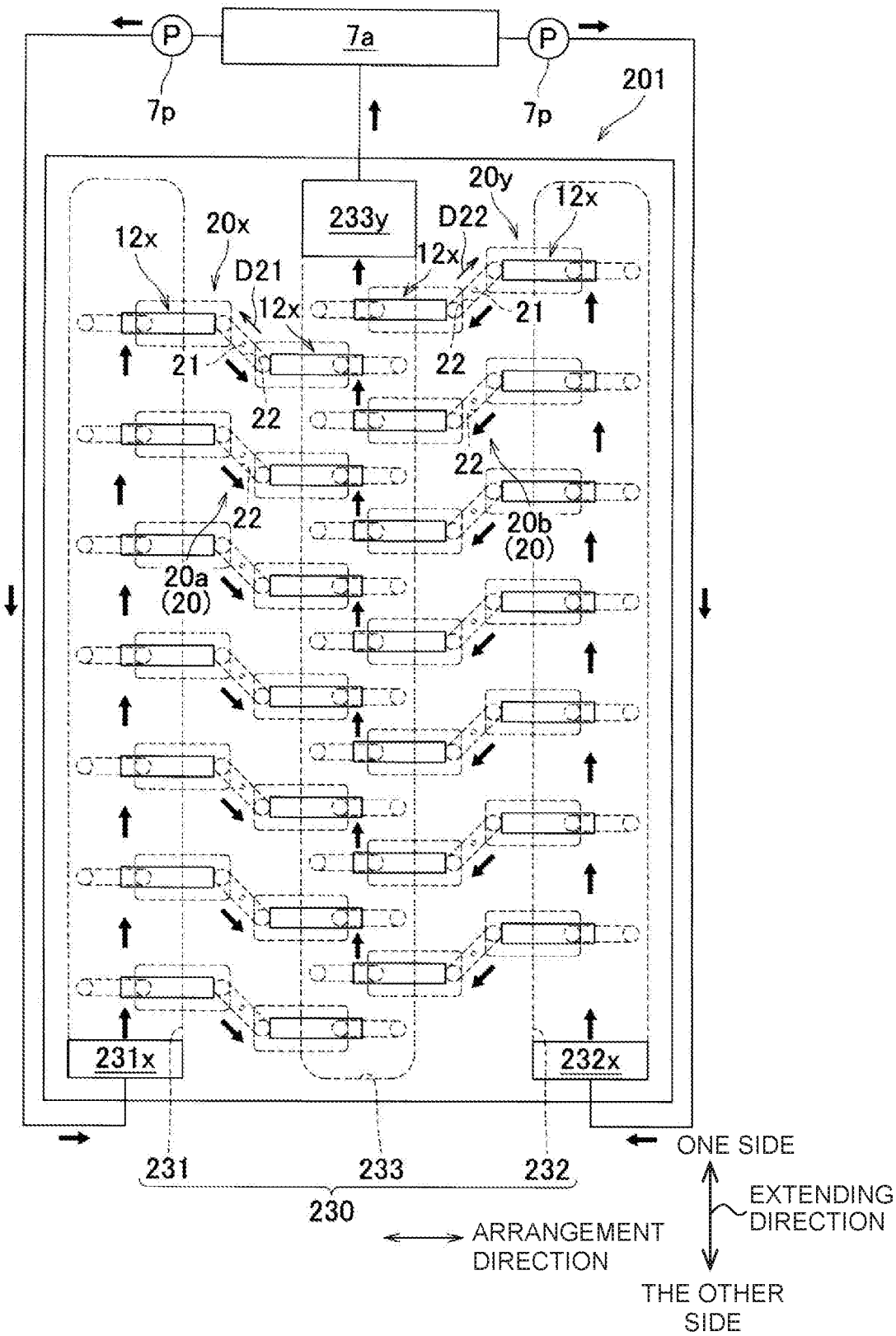
FIG. 5 is a plan view of a head according to a second embodiment of the present teaching.

Next, a head 201 according to a second embodiment of the present teaching will be described below by referring to FIG. 5. In the present embodiment, an arrangement of a common channel 230 differs from an arrangement of the common channel 33 in the first embodiment. Thick arrow marks in FIG. 5 depict the flow of ink.

The common channel 230 includes supply channels 231 and 232 and a return channel 233 arranged in rows in the arrangement direction. The supply channels 231 and 232 and the return channel 233 are extended in the extending direction. The return channel 233 is arranged between the supply channel 231 and the supply channel 232 in the arrangement direction.

In the present embodiment, the first individual channel 20*a* connects the supply channel 231 and the return channel 233. The second individual channel 20*b* connects the supply channel 232 and the return channel 233.

The supply channels 231 and 232 communicate with the storage chamber 7*a* via supply ports 231*x* and 232*x* respectively. The return channel 233 communicates with the storage chamber 7*a* via a discharge port 233*y*. The discharge port 233*y* is formed in the return channel 233, at an end portion in the one side in the extending direction (upward direction in FIG. 5). The supply ports 231*x* and 232*x* are formed in the supply channels 231 and 232 respectively, at an end portion in the other side in the extending direction (downward direction in FIG. 5).

A length of each of the supply ports 231*x* and 232*x*, and the discharge port 233*y* in the arrangement direction is mutually same, but a length of each of the supply ports 232*x* and 232$x$ in the extending direction is half of a length of the discharge port 233$y$ in the extending direction. In other words, an area of each of the supply ports 232$x$ and 232$x$ is half of an area of the discharge port 233$y$. Such arrangement is made upon taking into consideration the fact that the number of individual channels 20 connected to each of the supply channels 231 and 232 is half the number of individual channels 20 connected to the return channel 233 and the fact that an amount of ink that flows through each of the supply channels 231 and 232 is half an amount of ink that flows through the return channel 233.

The ink in the storage chamber 7$a$ is supplied to the supply channels 231 and 232 through the supply ports 231$x$ and 232$x$ by two circulation pumps 7$p$ being driven by a control of the controller 5. The ink supplied to the supply channel 231, while moving inside the supply channel 231 from the other side to the one side in the extending direction, is supplied to each of the first individual channels 20$a$. The ink supplied to the first individual channel 20$a$ flows into the return channel 233. The ink supplied to the supply channel 232, while moving inside the supply channel 232 from the other side to the one side in the extending direction, is supplied to each of the second individual channels 20$b$. The ink supplied to the second individual channel 20$b$ flows into the return channel 233. The ink flowed into the return channel 233, while moving inside the return channel 233 from the other side in the extending direction to the one side in the extending direction, is discharged from the return channel 233 via the discharge port 233$y$, and is returned to the storage chamber 7$a$.

The communicating channel 22 of the first individual channel 20$x$ and the communicating channel 22 of the second individual channel 20$y$ are both extended from the return channel 233 in a direction inclined with respect to the extending direction (direction intersecting with the extending direction and the arrangement direction). In other words, a communicating direction D21 of the first individual channel 20$x$ (direction in which the communicating channel 22 is extended from the return channel 233) and a communicating direction D22 of the second individual channel 20$y$ are both inclined with respect to the extending direction. The communicating directions D21 and D22 are mutually opposite in the arrangement direction, and have vectors toward the same side in the extending direction (the one side in the extending direction).

In the present embodiment, the communicating channels 22 of all the first individual channels 20$a$ are extended in the mutually same direction (the communicating direction D21) from the return channel 233. The communicating channels 22 of all the second individual channels 20$b$ are extended in the mutually same direction (the communicating direction D22) from the return channel 233.

In the present embodiment, the channel at the middle in the arrangement direction out of the three channels 231 to 233 forming the common channel 230, is the return channel 233 and not a supply channel, and the supply channels 231 and 232 are arranged on two sides in the arrangement direction of the return channel 233. Consequently, the flow of ink through the communicating channel 22 of the first individual channel 20$a$ and the flow of ink through the communicating channel 22 of the second individual channel 20$b$ are opposite to the respective flow of ink in the first embodiment (FIG. 2). In the present embodiment, a force in a direction from the supply channel 231 toward the return channel 233 (rightward direction in FIG. 5) acts on the ink that is jetted from the nozzle 21 of the first individual channel 20$a$. Moreover, a force in a direction from the supply channel 232 toward the return channel 233 (leftward direction in FIG. 5) acts on the ink that is jetted from the nozzle 21 of the second individual channel 20$b$. Consequently, in a case of not taking any measures, the ink jetted from the nozzle 21 of the first individual channel 20$a$ and the ink jetted from the nozzle 21 of the second individual channel 20$b$ fly in mutually opposite directions in the arrangement direction, and lands at positions shifted to one arrangement direction and the other of the arrangement direction respectively, with respect to the desired positions.

Therefore, the controller 5 (FIG. 4) of the printer which includes the head 201 of the present embodiment drives the actuator 12$x$ belonging to the first individual channel 20$a$ after the specified timing, and drives the actuator 12$x$ belonging to the second individual channel 20$b$ before the specified timing. In a case where the actuator 12$x$ belonging to the first individual channel 20$a$ is driven at the specified timing, the ink jetted from the nozzle 21 of the first individual channel 20$a$ flies downward in the conveyance direction due to an effect of the flow of ink from the supply channel 231 toward the return channel 233 through the first individual channel 20$a$, and lands (at a position) downstream of the conveyance direction with respect to the desired position. In the present embodiment, by driving the actuator 12$x$ belonging to the first individual channel 20$a$ after the specified timing, the landing position of the ink jetted from the nozzle 21 of the first individual channel 20$a$ is corrected to a position downstream of the conveyance direction. In a case where the actuator 12$x$ belonging to the second individual channel 20$b$ is driven at the specified timing, the ink jetted from the nozzle 21 of the second individual channel 20$b$ flies upward in the conveyance direction due to an effect of the flow of ink from the supply channel 232 toward the return channel 233 through the second individual channel 20$b$, and lands at a position upstream of the conveyance direction with respect to the desired position. In the present embodiment, by driving the actuator 12$x$ belonging to the second individual channel 20$b$ before the specified timing, the landing position of the ink jetted from the nozzle 21 of the second individual channel 20$b$ is corrected to a position upstream of the conveyance direction.

As mentioned heretofore, according to the present embodiment, although the arrangement of the supply channel 230 differs from the arrangement of the supply channel 30 in the first embodiment, the rest of the arrangement being similar to that in the first embodiment, an effect similar to that of the first embodiment is achieved.

For instance, the communicating direction D21 of the first individual channel 20$x$ and the communicating direction D22 of the second individual channel 20$y$) are both inclined with respect to the extending direction, and have vectors toward the one side in the extending direction (upward direction in FIG. 5). Therefore, according to a theory similar to that in the first embodiment, it is possible to suppress the dots from being sparse and dense in the extending direction.

The communicating direction D21 for each of the first individual channels 20$a$ and the communicating direction D22 for each of the second individual channels 20$b$ are both inclined with respect to the extending direction, and have vectors toward the one side in the extending direction (upward direction in FIG. 5). In this case, there is an empty space developed in the one side in the extending direction of the return channel 233 and the other side in the extending direction of the supply channels 231 and 232. By providing the discharge port 233$y$ and the supply ports 231 and 232 in the space thereby making an effective use of the space, it is possible to make size of the head 201 small in the extending direction.

The controller 5 drives the actuator 12*x* belonging to the first individual channel 20*a* after the specified timing of a case in which the communicating directions D1 and D2 are parallel to the extending direction and drives the actuator 12*x* belonging to the second individual channel 20*b* before the specified timing. In this case, it is possible to suppress the dots from becoming sparse and dense in the extending direction by the arrangement of the individual channel 20, and also to suppress the dots from becoming sparse and dense in the arrangement direction by the control of the controller 5.

Third Embodiment

Next, a head 301 according to a third embodiment of the present teaching will be described below by referring to FIG. 6 and FIG. 7. In the present embodiment, a channel arrangement of the head 301 differs from a channel arrangement of the head 1 of the first embodiment. Thick arrow marks in FIG. 6 and arrow marks in FIG. 7 depict a flow of ink.

A channel substrate 311 of the head 301 has five plates 311*a*, 311*b*, 311*c*. 311*d*, and 311*e* adhered to one another. The common channel 30 is formed in the plate 311*a*. The supply port 33*x* and the discharge ports 31*y* and 32*y* (refer to FIG. 6) open on an upper surface of the plate 311*a*. Individual channels 320 are formed in the plates 311*b* to 311*e*. The individual channels 320 are positioned at a lower side of the common channel 30.

Each individual channel 320 includes a nozzle 321, a pressure chamber 323 (communicating channel 322) and two joining channels 325. The pressure chamber 323 corresponds to the communicating channel 322 which runs directly above the nozzle 321. In other words, the pressure chamber 323 is positioned directly above the nozzle 321, and communicates with the nozzle 321 directly without interposing a connecting channel and the like therebetween.

The nozzle 321 is a through hole formed in the plate 311*e*. The pressure chamber 323 is a through hole formed in the plates 311*c* and 311*d*. A recess 311*bx* is formed in a lower surface of the plate 311*b*, at a position facing each pressure chamber 323. The plate 311*b* is adhered to an upper surface of the plate 311*c* such that the individual electrode 12*d* and the piezoelectric body 12*c* of the actuator unit 12 are arranged inside the recess 311*bx*. The vibration plate 12*a* and the common electrode 12*b* of the actuator unit 12 are arranged on nearly entire upper surface of the plate 311*c*, and cover the pressure chambers 323. The joining channel 325 is a through hole formed in the plate 311*b*, the vibration plate 12*a*, and the common electrode 12*b*.

Figure 6:
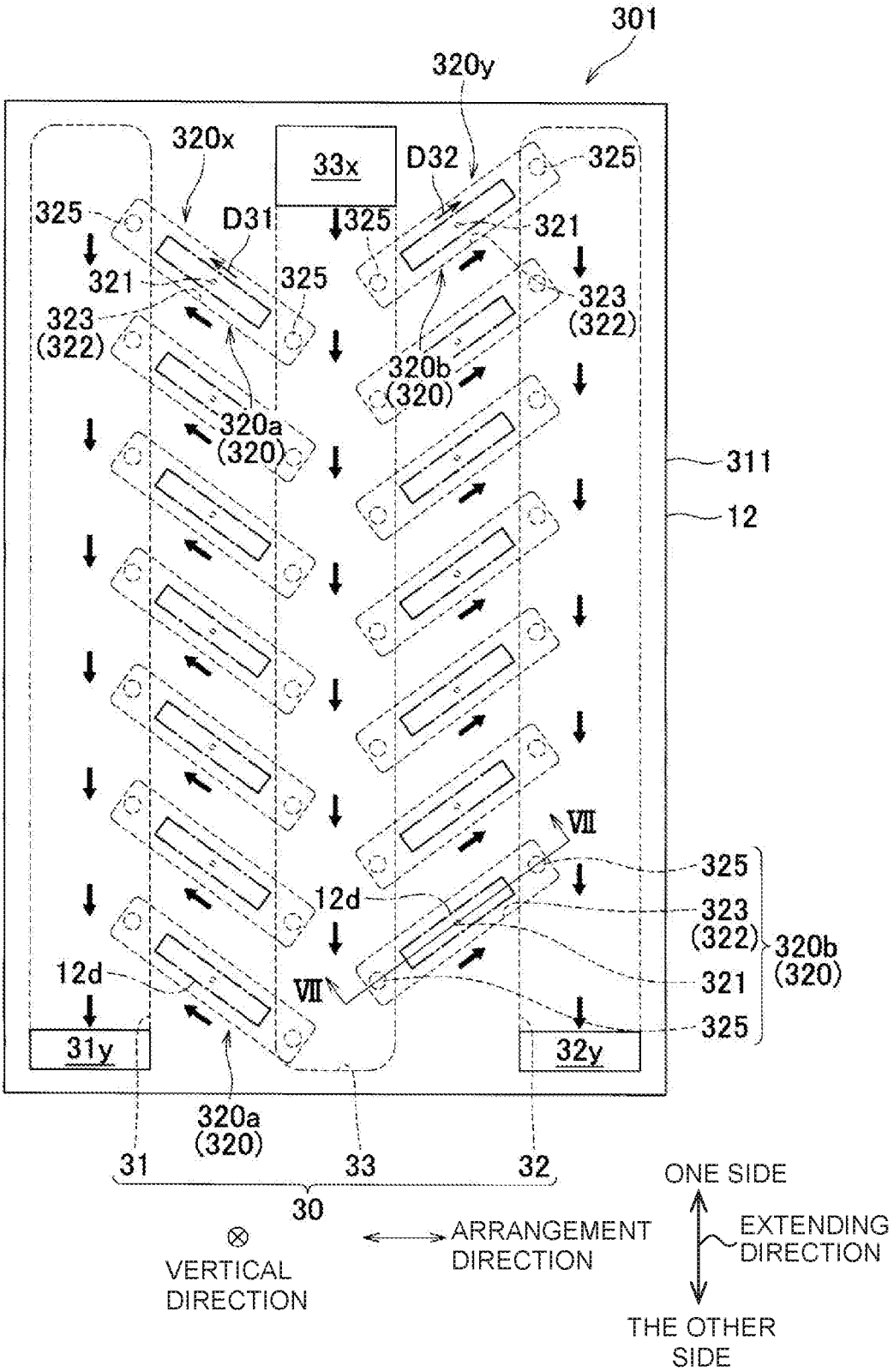
FIG. 6 is a plan view of a head according to a third embodiment of the present teaching.
Figure 7:
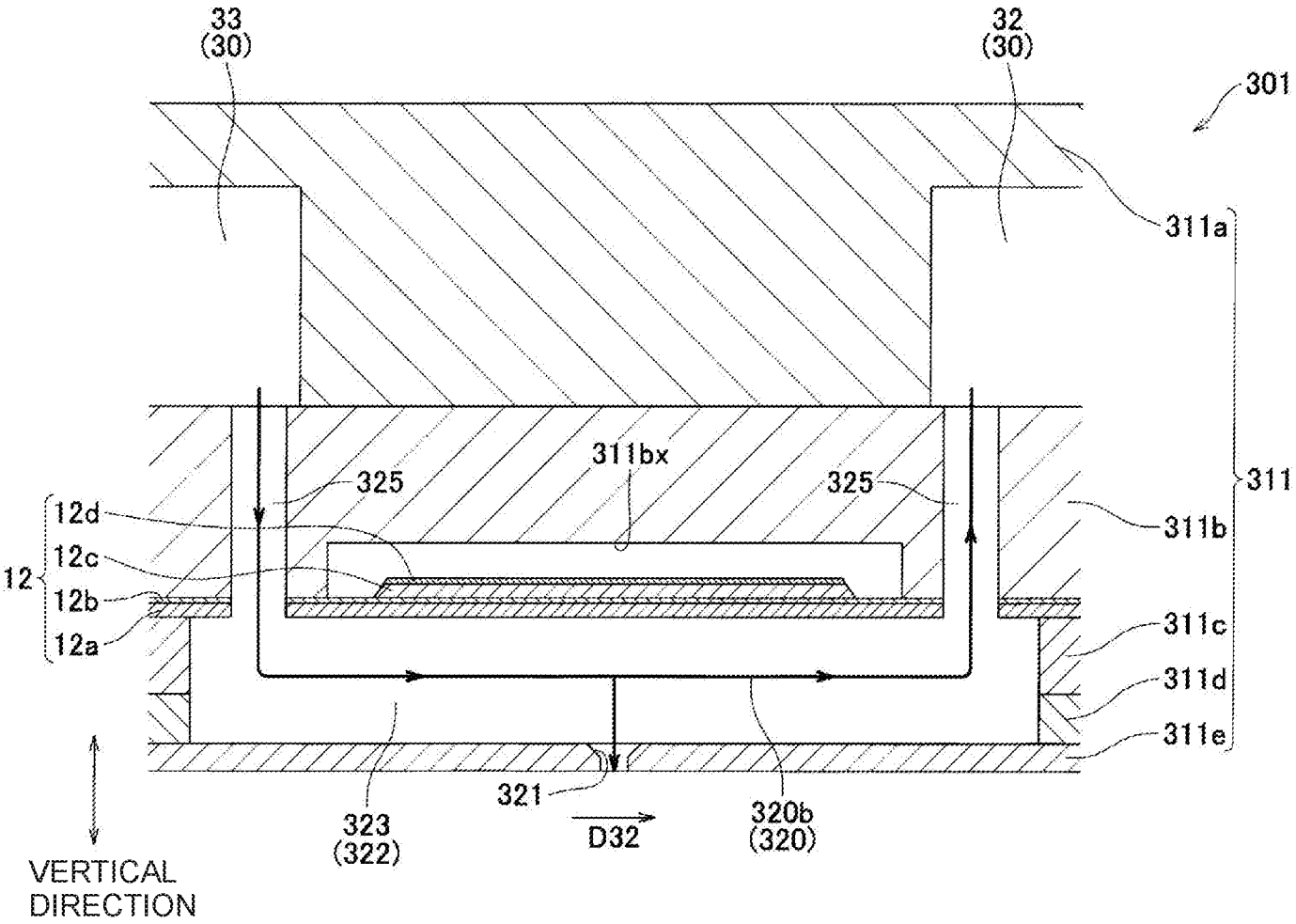
FIG. 7 is a cross-sectional view of the head along a line VII-VII in FIG. 6.

The individual channel 320, as depicted in FIG. 6, includes first individual channels 320*a* connecting the return channel 31 and the supply channel 33 and second individual channels 320*b* connecting the return channel 32 and the supply channel 33. The first individual channel 320*a* is spread over the return channel 31 and the supply channel 33 in the arrangement direction. The second individual channel 320*b* is spread over the return channel 32 and the supply channel 33 in the arrangement direction.

Here, let the first individual channel 320*a* at the uppermost side of the first individual channels 320*a* in FIG. 6 be a certain first individual channel 320*x* and let the second individual channel 320*b* at the uppermost side of the second individual channels 320*b* in FIG. 6 be a certain second individual channel 320*y*. The nozzle 321 in the first individual channel 320*x* and the nozzle 321 in the second individual channel 320*y* are mutually adjacent in the extending direction (in other words, no other nozzle 321 is arranged between the nozzle 321 in the first individual channel 320*x* and the nozzle 21 in the second individual channel 320*y*). The pressure chamber 323 (communicating channel 322) of the first individual channel 320*x* and the pressure chamber 323 (communicating channel 322) of the second individual channel 320*y* are both extended from the supply channel 33 in a direction inclined with respect to the extending direction (a direction intersecting with the extending direction and the arrangement direction). In other words, a communicating direction D31 of the first individual channel 320*x* (direction in which the pressure chamber 323 corresponding to the communicating channel 322 is extended from the supply channel 33) and a communicating direction D32 of the second individual channel 320*y* are both inclined with respect to the extending direction. The communicating directions D31 and D32 are mutually opposite in the arrangement direction, and have vectors toward the same side in the extending direction (the one side in the extending direction).

In the present embodiment, the pressure chambers 323 (communicating channels 322) of all the first individual channels 320*a* are extended in the mutually same direction (communicating direction D31) from the supply channel 33. The pressure chambers 323 (communicating channels 322) of all the second individual channels 320*b* are extended in the mutually same direction (communicating direction D32).

One end and the other end in the communicating directions D31 and D32 of each pressure chamber 323 overlap in the vertical direction with the supply channel 33 and one of the return channel 31 and the return channel 32. More specifically, one end in the communicating direction D31 of the pressure chamber 323 of the first individual channel 320*a* overlaps in the vertical direction with the supply channel 33, and the other end in the communicating direction D31 of the pressure chamber 323 of the first individual channel 320*a* overlaps in the vertical direction with the return channel 31. One end in the communicating direction D32 of the pressure chamber 323 of the second individual channel 320*b* overlaps in the vertical direction with the supply channel 33 and the other end in the communicating direction D32 of the pressure chamber 323 of the second individual channel 320*b* overlaps in the vertical direction with the return channel 32. The joining channel 325 is arranged at each of the one end and the other end in the communicating directions D31 and D32 of each pressure chamber 323.

For each individual channel 320, one of the two joining channels 325, as depicted in FIG. 7, is extended upward from the pressure chamber 323, and is connected to the supply channel 33. The other of the two joining channels 325 is extended upward from the pressure chamber 323, and is connected either to the return channel 31 or to the return channel 32.

The ink supplied to each individual channel 320 moves downward through one of the communicating channels 25, and is supplied to the pressure chamber 323. The ink supplied to the pressure chamber 323 moves horizontally, and after a part thereof being jetted from the nozzle 321, the remaining ink moves upward through the other communicating channel 25 and flows either into the return channel 31 or into the return channel 32.

As mentioned heretofore, according to the present embodiment, although the channel arrangement of the head 301 differs from the channel arrangement of the head 1 of the first embodiment, the rest of the arrangement being similar to that in the first embodiment, an effect similar to that of the first embodiment is achieved.

For instance, the communicating direction D31 of the first individual channel 320*x* and the communicating direction D32 of the second individual channel are both inclined with respect to the extending direction, and have vectors toward the one side in the extending direction (upward direction in FIG. 6). Therefore, according to a theory similar to that in the first embodiment, it is possible to suppress the dots from being sparse and dense in the extending direction.

Fourth Embodiment

Figure 8:
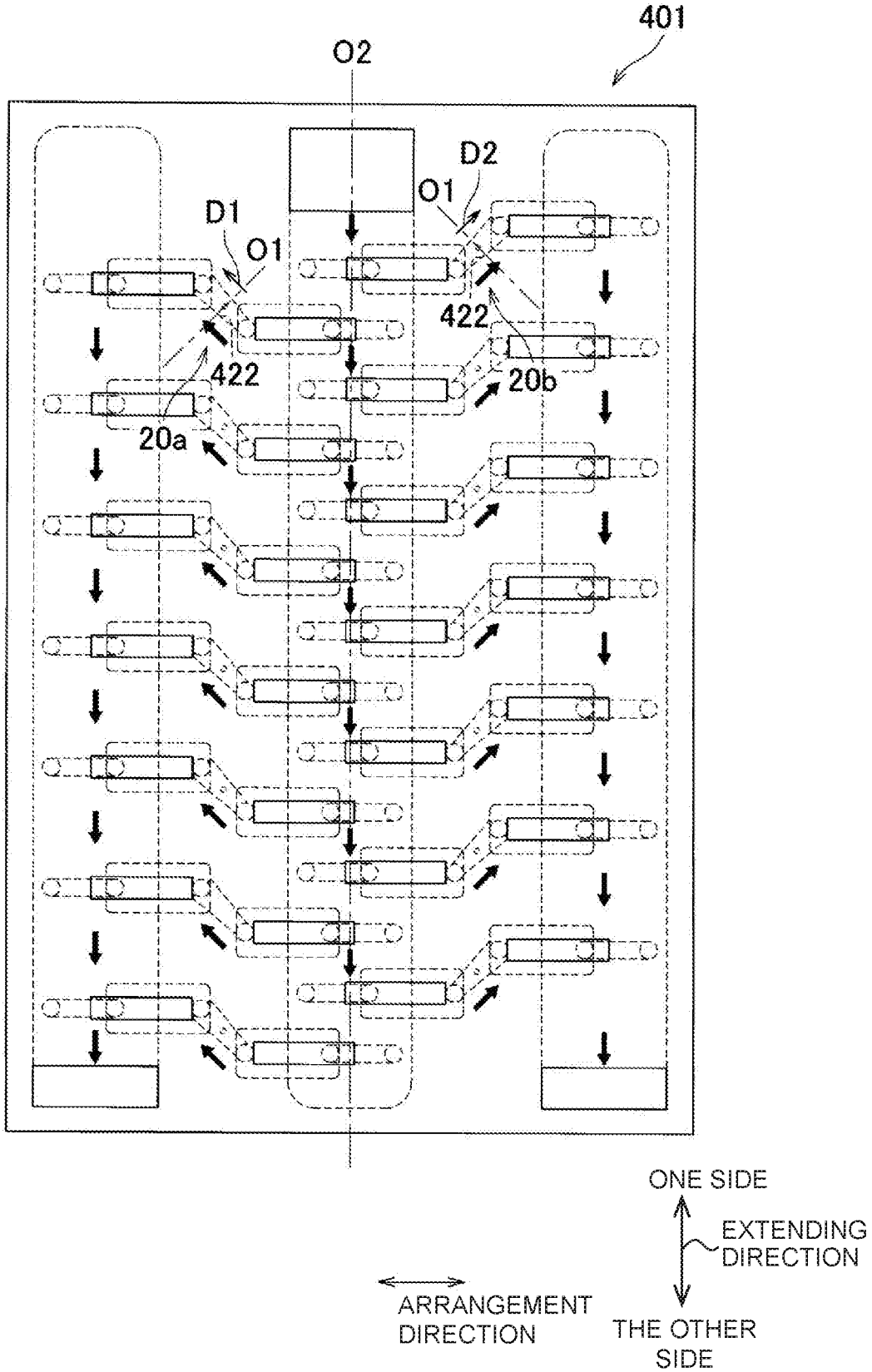
FIG. 8 is a plan view of a head according to a fourth embodiment of the present teaching.

Next, a head 401 according to a fourth embodiment of the present teaching will be described below by referring to FIG. 8. In the present embodiment, a shape of a communicating channel 422 differs from a shape of the communicating channel in the first embodiment. Thick arrow marks in FIG. 8 depict a flow of ink.

In the present embodiment, the communicating channel 422 in the first individual channel 20*a* and the communicating channel 422 in the second individual channel 20*b* have an asymmetric shape with respect to a first center line O1. The first center line O1 passes through a center of the communicating channel 422 in the communicating directions D1 and D2, and is a line which is orthogonal to the communicating directions D1 and D2 and is along a surface (horizontal surface) including the arrangement direction and the extending direction. More specifically, a width of each communicating channel 422 increases gradually toward the downstream of the communicating directions D1 and D2. Moreover, the communicating channel 422 in the first individual channel 20*a* and the communicating channel 422 in the second individual channel 20*b* have a mutually symmetric shape with respect to a second center line O2. The second center line O2 passes through a center of the supply channel 30 in the arrangement direction, and is a line along the extending direction.

According to the present embodiment, even in a case in which the communicating channel 422 does not have a fixed shape in the communicating directions D1 an D2, by the rest of the arrangement being similar to the arrangement in the first embodiment, an effect that it is possible to suppress the dots from being sparse and dense in the extending direction is achieved. Here, the "mutually symmetric shape" means a case in which the symmetry is not perfect but there is a minute difference in the two shapes, in addition to a case in which the shape is perfectly symmetric mutually.

Fifth Embodiment

Next, a head 501 according to a fifth embodiment will be described below by referring to FIG. 9. The communicating direction D51 in the first individual channel 20*a*, a magnitude correlation of an area of the communicating channel 22 in the first individual channel 20*a* and the second individual channel 20*b*, a position of a supply port 533*x*, and a flow direction of ink in the supply channel in the present embodiment differ from that in the first embodiment. Thick arrow marks in FIG. 9 depict a flow of ink.

Figure 9:
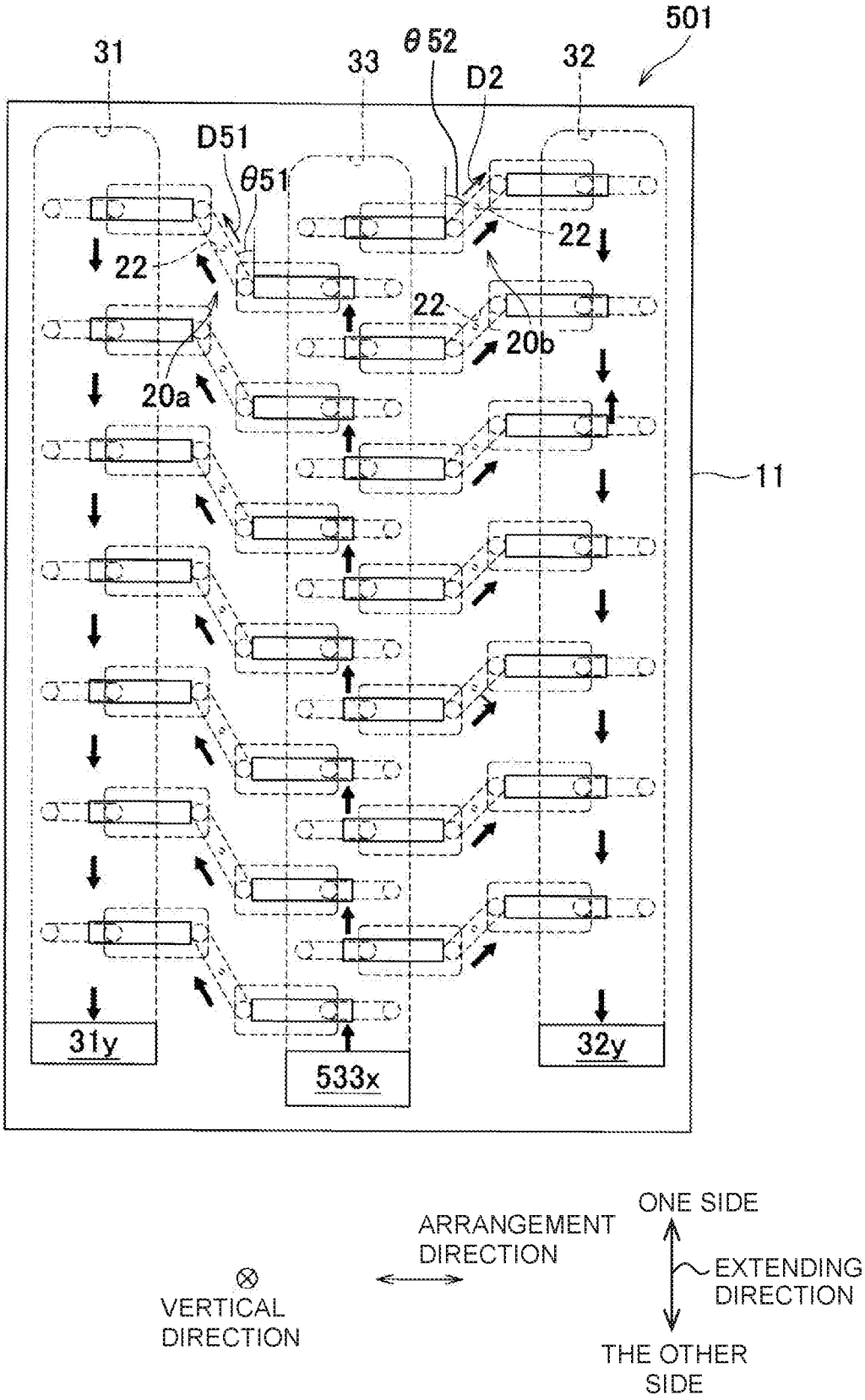
FIG. 9 is a plan view of a head according to a fifth embodiment of the present teaching.

The supply port 533*x* is formed at an end portion of the supply channel 33 on the other side in the extending direction (downward direction in FIG. 9). In other words, the supply port 533*x* is provided in the same direction as the display ports 31*y* and 32*y* of the return channels 31 and 32 with respect to a center of the channel substrate 11 of the head 501. An ink supplied from to the supply channel 33 through the supply port 533*x*, while moving inside the supply channel 33 from the other side in the extending direction to the one side in the extending direction, is supplied to each of the first individual channel 20*a* and the second individual channel 20*b*. The flow direction of the ink in the supply channel 33 and the flow direction of the ink in the return channels 31 and 32 are mutually opposite directions.

Angle θ51 made by the communicating direction D51 with respect to the flow direction (direction in which the ink flows in the supply channel 33 along the extending direction, and the one side in the extending direction in the present embodiment) is smaller than an angle θ52 made by the communicating direction D2 (approximately 45 degrees, similar to the angle θ2), and is nearly 30 degrees. The communicating direction D51, similar to the communicating direction D1, is inclined with respect to the extending direction, and is opposite to the communicating direction D2 in the arrangement direction, and has a vector toward the same side in the extending direction (the one side in the extending direction).

In a case where a cross-sectional area of the communicating channel 22 is constant, as the angles θ51 and θ52 made by the communicating direction with respect to the flow direction become smaller (in other words, approaching the flow direction), a flow velocity of ink flowing through the communicating channel 22 becomes large. Therefore, in the present embodiment, the cross-sectional area of the communicating channel 22 of the first individual channel 20*a* is large, because the angle θ51 is smaller than the angle θ52. In other words, the cross-sectional area of the communicating channel 22 in the first individual channel 20*a* is larger than the cross-sectional area of the communicating channel 22 in the second individual channel 20*b*. More specifically, a length in a vertical direction of the communicating channel 22 in the first individual channel 20*a* is longer than a length in the vertical direction of the communicating channel 22 in the second individual channel 20*b*. Alternatively, in addition to this, or instead of this, a width of the communicating channel 22 in the first individual channel 20*a* (a length in a direction along a plane (horizontal plane) orthogonal to the communicating direction D51 and spread in both the arrangement direction and the extending direction) is longer than a width of the communicating channel 22 in the second individual channel 20*b*. Accordingly, for the first individual channel 20*a* and the second individual channel 20*b*, it is possible to make uniform the flow velocity of the ink flowing through the communicating channel 22.

Sixth Embodiment

Next, a head 601 according to a sixth embodiment of the present teaching will be described below by referring to FIG. 10 and FIG. 11. In the present embodiment, a channel arrangement of the head 601 differs from the channel arrangement of the head 1 of the first embodiment. The arrangement of the common channel 230 is same as in the second embodiment. Thick arrow marks in FIG. 10 and arrow marks in FIG. 11 depict a flow of ink.

Figure 11:
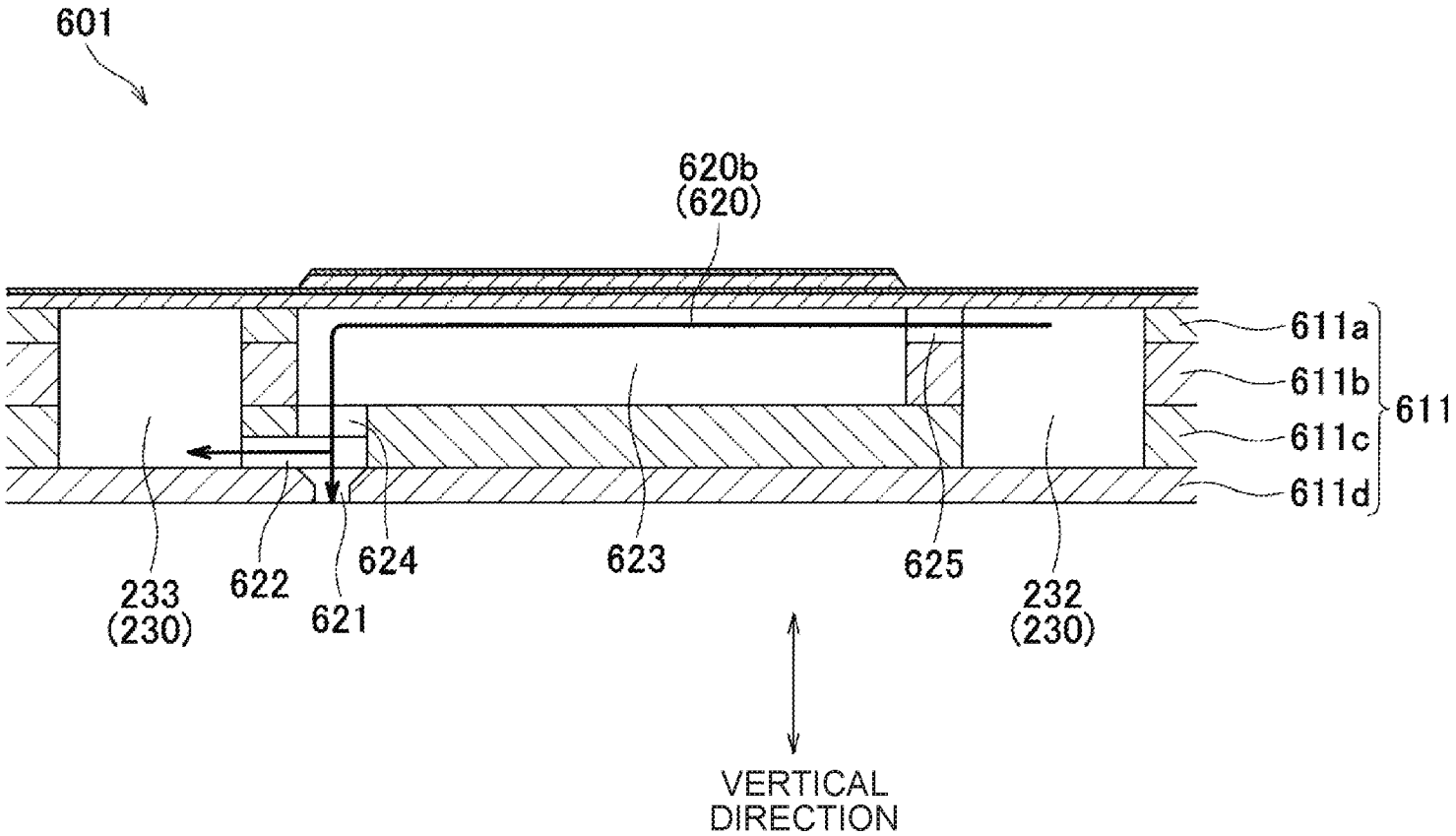
FIG. 11 is a cross-sectional view of the head along a line XI-XI in FIG. 10.

A channel substrate 611 of the head 601, as depicted in FIG. 11, has four plates 611*a*, 611*b*. 611*c*, and 611*d* adhered to one another. The common channel 230 (the supply channels 231 and 232, and the return channel 233) is formed in the plates 611*a* to 611*c*. Individual channels 620 are formed in the plates 611*a* to 611*d*.

Each individual channel 620 includes a nozzle 621, a communicating channel 622, one pressure chamber 623, a connecting channel 624, and a joining channel 625. Components of each individual channel 620, other than the nozzle 621, are formed in the plates 611*a* to 611*c*, and overlap with the communicating channel 230 (the supply channels 231 and 232, and the return channel 233) in the arrangement direction. The nozzle 621 is a through hole formed in the plate 611*d*. The pressure chamber 623 communicates with either the supply channel 231 or the supply channel 232 via the joining channel 625, and communicates with the nozzle 621 via the connecting channel 624 and the communicating channel 622. The communicating channel 622 is a channel running directly above the nozzle 621, and is arranged between the connecting channel 624 and the nozzle 621, and between the connecting channel 624 and the return channel 233. The communicating channel 622 is extended from a lateral side of the return channel 233, and the joining channel 625 is extended from a lateral side of either the supply channel 231 or the supply channel 232.

The supply channels 231 and 232, the return channel 233, the pressure chambers 623, and the joining channels 625 open on an upper surface of the plate 611*a*. The vibration plate 12*a* and the common electrode 12*b* of the actuator unit 12 are arranged on nearly the entire upper surface of the plate 611*a*, and cover the supply channels 231 and 232, the return channel 233, the pressure chambers 623, and the joining channels 625. In the vibration plate 12*a* and the common electrode 12*b*, through holes are formed at positions corresponding to the supply ports 231*x* and 232*x*, and the discharge port 233*y* (refer to FIG. 10). The supply ports 231*x* and 232*x*, and the discharge port 233*y* open on an upper surface of the head 601, and communicate with the supply channels 231 and 232, and the return channel 233 via the through holes.

Figure 10:
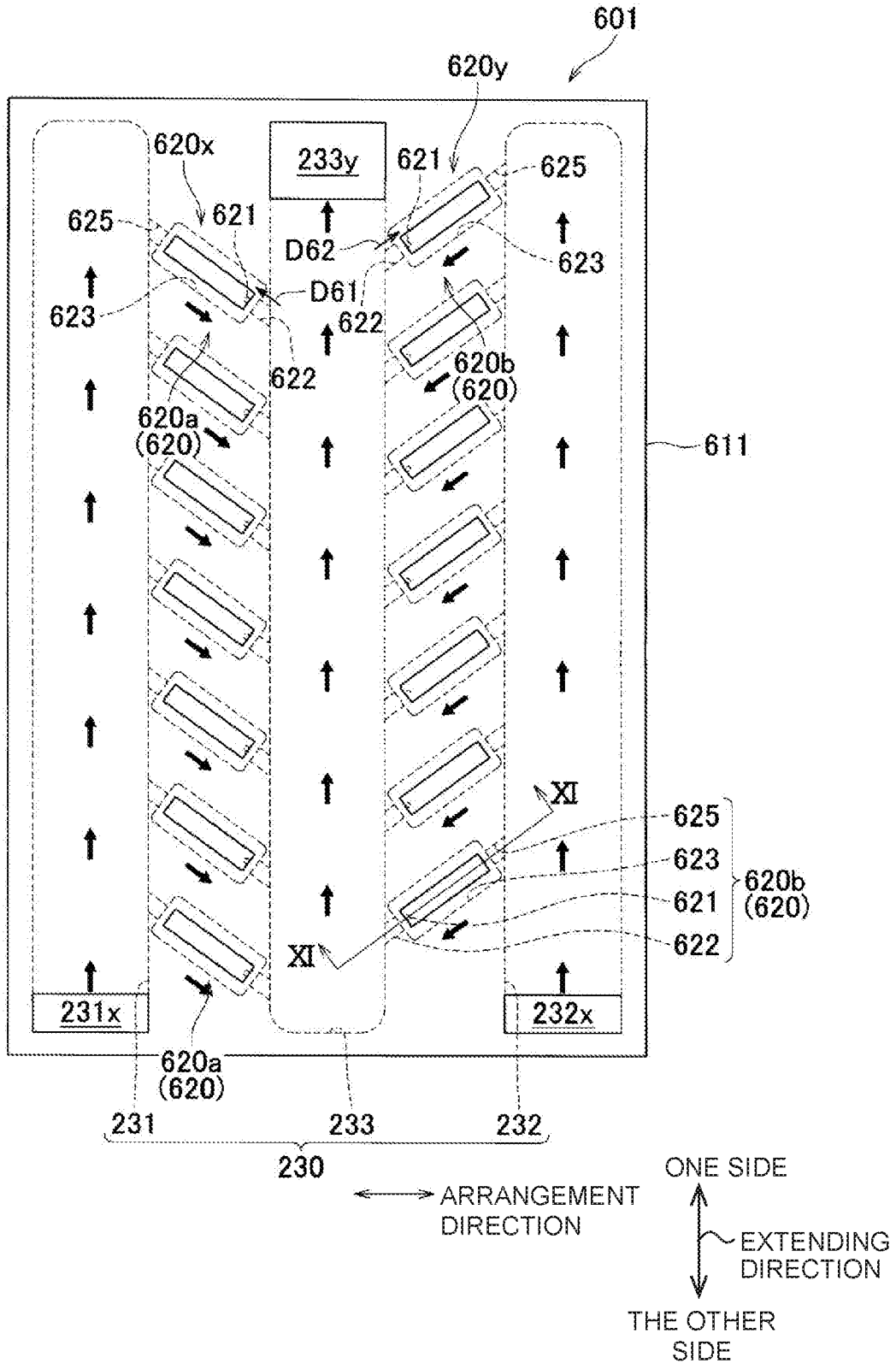
FIG. 10 is a plan view of a head according to a sixth embodiment of the present teaching.

The individual channel 620, as depicted in FIG. 10, includes first individual channels 620*a* connecting the supply channel 231 and the return channel 233, and second individual channels 620*b* connecting the supply channel 232 and the return channel 233.

Here, let the first individual channel 620*a* at the uppermost side of the first individual channels 620*a* in FIG. 10 be a certain first individual channel 20*x* and let the second individual channel 620*b* at the uppermost side of the second individual channels 620*b* in FIG. 10 be a certain second individual channel 620*y*. The nozzle 621 in the first individual channel 620*x* and the nozzle 621 in the second individual channel 620*y* are mutually adjacent in the extending direction (in other words, no other nozzle 621 is arranged between the nozzle 621 in the first individual channel 620*x* and the nozzle 621 in the second individual channel 620*y*). The communicating channel 622 of the first individual channel 620*x* and the communicating channel 622 of the second individual channel 620 are both extended from the return channel 233 in a direction inclined with respect to the extending direction (a direction intersecting with the extending direction and the arrangement direction). In other words, a communicating direction D61 of the first individual channel 620*x* (direction in which the communicating channel 622 is extended from the return channel 233) and a communicating direction D62 of the second individual channel 620*y* are both inclined with respect to the extending direction. The communicating directions D61 and D62 are mutually opposite in the arrangement direction, and have vectors toward the same side in the extending direction (the one side in the extending direction: upward direction in FIG. 10).

In the present embodiment, the communicating channels 622 of all the first individual channels 620*a* are extended in the mutually same direction (communicating direction D61) from the return channel 233. The communicating channels 622 of all the second individual channels 620*b* are extended in the mutually same direction (communicating direction D62). Furthermore, the pressure chambers 623 and the joining channels 625 of all the first individual channels 620 are extended in mutually same direction (communicating direction D61) from the return channel 233. The pressure chambers 623 and the joining channels 625 of all the second individual channels 620*b* are extended in mutually same direction (communicating direction D62) from the return channel 233.

Ink supplied to each individual channel 620, as depicted in FIG. 11, upon moving horizontally through the joining channel 625 and the pressure chamber 623, moves downward through the connecting channel 624, and flows into the communicating channel 622. The ink, while moving horizontally through the communicating channel 622, a part thereof is jetted through the nozzle 621, and the remaining ink flows into the return channel 233.

As mentioned heretofore, according to the present embodiment, although the channel arrangement of the head 601 differs from the channel arrangement of the head 1 of the first embodiment, the rest of the arrangement being similar to that in the first embodiment, an effect similar to that of the first embodiment is achieved.

For instance, the communicating direction D61 of the first individual channel 620*x* and the communicating direction D62 of the second individual channel 620*y* are both inclined with respect to the extending direction, and have vectors toward the one side in the extending direction (upward direction in FIG. 10). Therefore, according to a theory similar to that in the first embodiment, it is possible to suppress the dots from being sparse and dense in the extending direction.

Seventh Embodiment

Figure 12:
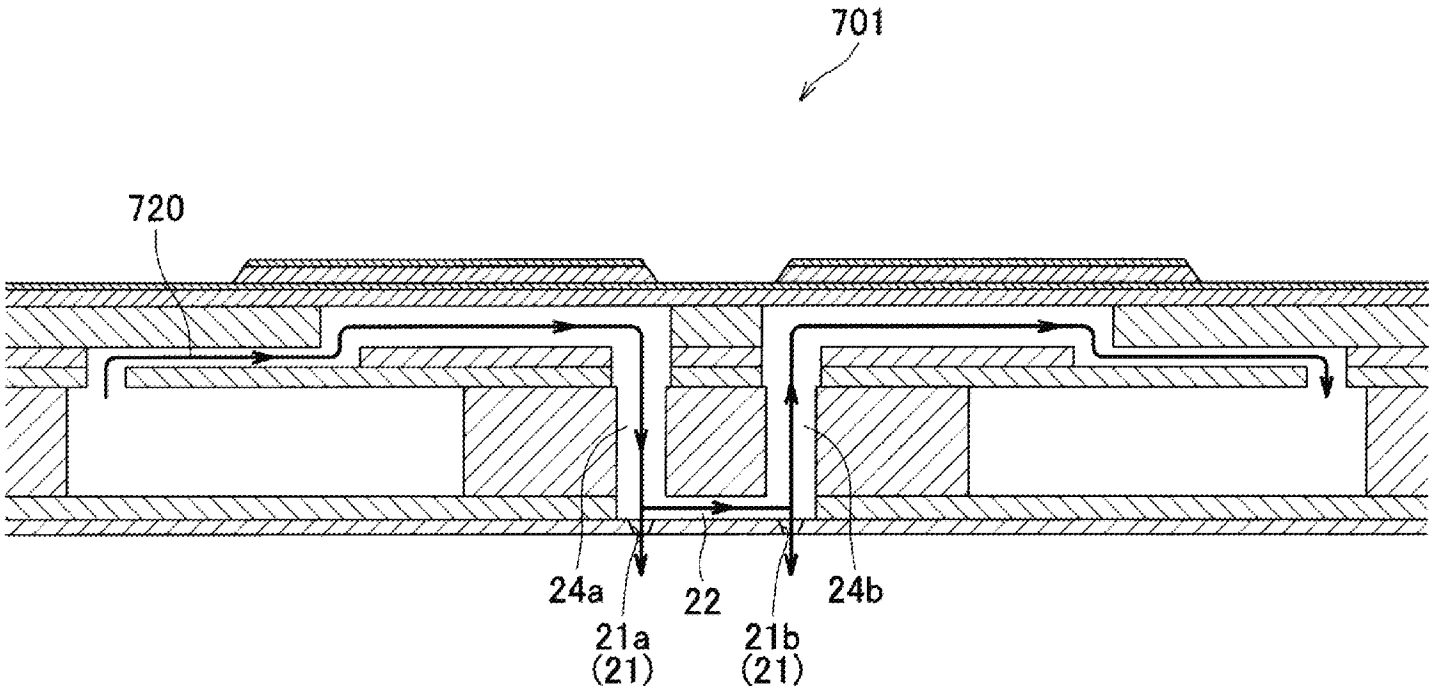
FIG. 12 is a cross-sectional view corresponding to FIG. 3 of a head according to a seventh embodiment of the present teaching.

Next, a head 701 according to a seventh embodiment of the present teaching will be described below by referring to FIG. 12. In the present embodiment, the number of nozzles 21 in each individual channel 720 differs from the number of nozzles in each individual channel 20 of the first embodiment. Arrow marks in FIG. 12 depict a flow of ink.

Each individual channel 720 includes two nozzles 21. The two nozzles 21 (a first nozzle 21*a* and a second nozzle 21*b*) are directly below the first connecting channel 24*a* and the second connecting channel 24*b*, and are arranged at the one end and the other end in the communicating direction of the communicating channel 22.

Ink that has moved downward through the first connecting channel 24*a* and flowed into the communicating channel 22 moves horizontally through the communicating channel 22, and a part of the ink is jetted through the first nozzle 21*a*. The remaining ink moves further and a part thereof is jetted through the second nozzle 21*b*, and the ink remained moves upward through the second connecting channel 24*b*.

As mentioned heretofore, according to the present embodiment, although the number of nozzles 21 in the individual channel 720 differs from that in the first embodiment, the rest of the arrangement being similar to the arrangement in the first embodiment, an effect similar to that of the first embodiment is achieved.

Eighth Embodiment

Figure 13:
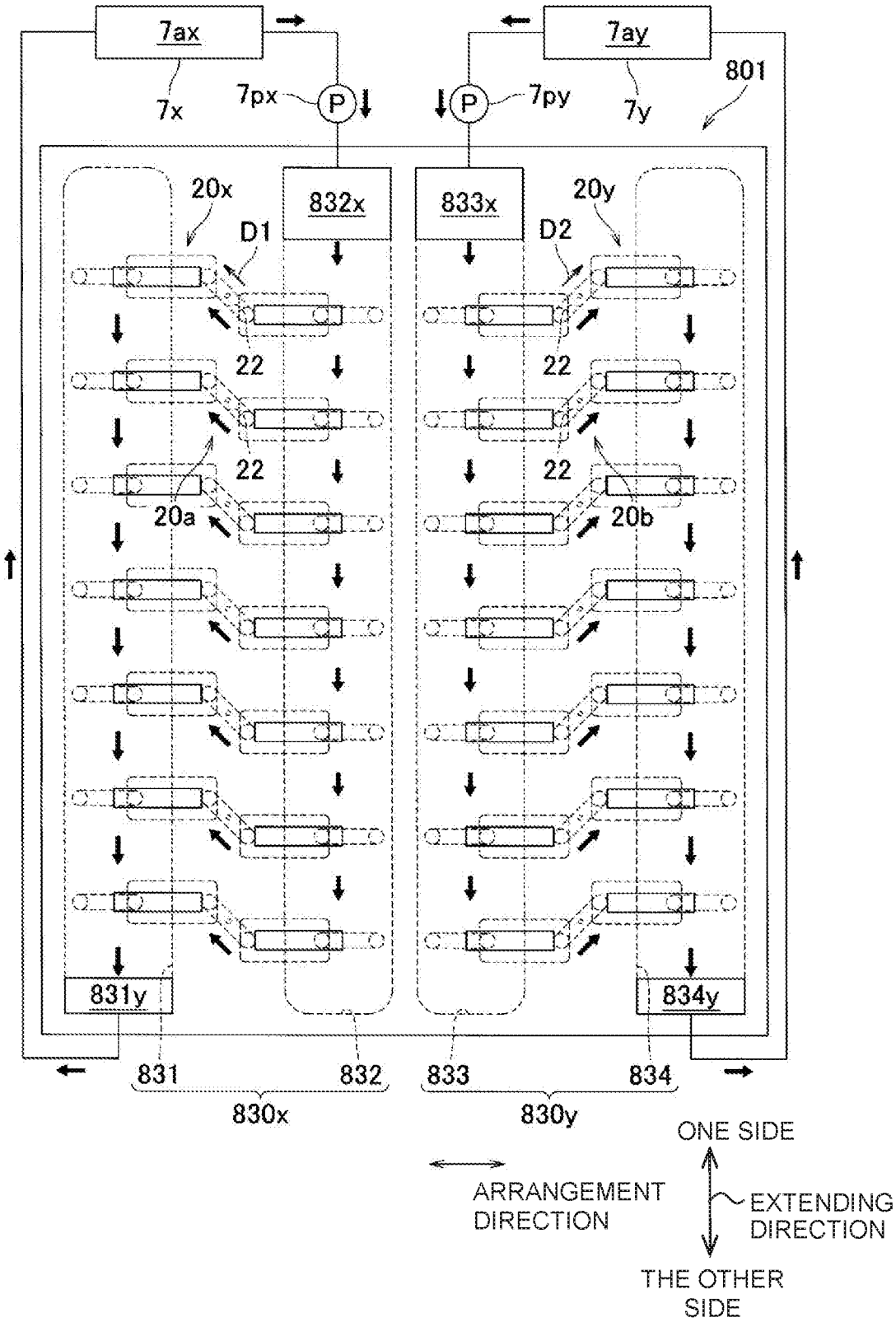
FIG. 13 is a plan view of a head according to an eighth embodiment of the present teaching.

Next, a head 801 according to an eighth embodiment of the present teaching will be described below. In the present embodiment, an arrangement of the common channel differs from an arrangement of the common channel in the first embodiment. Arrow marks in FIG. 13 depict a flow of ink.

The head 801 has a first common channel set 830*x* which includes a return channel 831 and a supply channel 832, and a second common channel set 830*y* which includes a supply channel 833 and a return channel 834.

The abovementioned four channels 831, 832, 833, and 834 are arranged in the arrangement direction, and are mutually extended in the extending direction. In other words, the first common channel set 830*x* and the second common channel set 830*y* are arranged in the arrangement direction. In the first common channel set 830*x*, the return channel 831 and the supply channel 832 are arranged in the arrangement direction and are mutually extended in the extending direction. In the second common channel set 830*y*, the supply channel 833 and the return channel 834 are arranged in the arrangement direction and are mutually extended in the extending direction.

Sub tanks 7*x* and 7*y* are provided for the first common channel set 830*x* and the second common channel set 830*y* respectively. For instance, the sub tanks 7*x* and 7*y* store inks of mutually different types (such as different colors).

The supply channel 832 communicates with a storage chamber 7*ax* via a supply port 832*x* and the return channel 831 communicates with the storage chamber 7*ax* via a discharge port 831*y*.

The supply channel 833 communicates with a storage chamber 7*ay* of the sub tank 7*y* via a supply port 833*x*. The return channel 834 communicates with the storage chamber 7*ay* via a discharge port 834*y*.

In the present embodiment, the first individual channel 20*a* connects the return channel 831 and the supply channel 832. The second individual channel 20*b* connects the supply channel 833 and the return channel 834.

Ink in the storage tank 7*ax* is supplied to the supply channel 832 through the supply port 832*x* by a circulation pump 7*px* being driven by a control of the controller 5. The ink supplied to the supply channel 832, while moving inside the supply channel 832 from the one side to the other side in the extending direction, is supplied to each of the first individual channels 20*a*. The ink supplied to the first individual channel 20*a* flows into the return channel 831, and moves inside the return channel 831 from the one side to the other side in the extending direction. Thereafter, the ink is discharged from the return channel 831 via the discharge port 831*y*, and is returned to the storage chamber 7*ax*.

The ink in the storage tank 7*ay* is supplied to the supply channel 833 through the supply port 833*x* by a circulation pump 7*py* being driven by a control of the controller 5. The ink supplied to the supply channel 833, while moving inside the supply channel 833 from the one side to the other side in the extending direction, is supplied to each of the second individual channels 20*b*. The ink supplied to the second individual channel 20*b* flows into the return channel 834, and moves inside the return channel 834 from the one side to the other side in the extending direction. Thereafter, the ink is discharged from the return channel 834 via the discharge port 834*y*, and is returned to the storage chamber 7*ay*.

The communicating channel 20*x* of the first individual channel 20*x* is extended from the supply channel 832 toward the return channel 831 in a direction inclined with respect to the extending direction (a direction intersecting with the extending direction and the arrangement direction). The communicating channel 22 of the second individual channel 20*y* is extended from the supply channel 833 toward the return channel 834 in a direction inclined with respect to the extending direction (a direction intersecting with the extending direction and the arrangement direction). In other words, the communicating direction D1 of the first individual channel 20*x* (direction in which the communicating channel 22 is extended from the supply channel 832 toward the return channel 831) and the communicating direction D2 of the second individual channel 20*y* (direction in which the communicating channel 22 is extended from the supply channel 833 toward the return channel 834) are both inclined with respect to the extending direction. The communicating directions D1 and D2 are mutually opposite in the arrangement direction, and have vectors toward the same side in the extending direction (the one side in the extending direction).

In the present embodiment, the communicating channels 22 of the all the first individual channels 20*a* are extended in the mutually same direction (communicating direction D1) from the supply channel 832 toward the return channel 831. The communicating channels 22 of all the second individual channels 20*b* are extended in the mutually same direction (communicating direction D2) from the supply channel 833 toward the return channel 834.

As mentioned heretofore, according to the present embodiment, although the arrangement of the common channel differs from the arrangement of the common channel in the first embodiment, the rest of the arrangement being similar to that in the first embodiment, an effect similar to that of the first embodiment is achieved.

For instance, the communicating direction D1 of the first individual channel 20*x* and the communicating direction D2 of the second individual channel 20*y* are both inclined with respect to the extending direction, and have vectors toward the one side in the extending direction (upward direction in FIG. 13). Therefore, according to a theory similar to that in the first embodiment, it is possible to suppress the dots from being sparse and dense in the extending direction.

Modified Embodiments

Embodiments of the present teaching have been described heretofore. However, the present teaching is not restricted to the embodiments described above, and various design modifications are possible within the scope of the patent claim.

The number of common channels is three in the abovementioned embodiments from the first embodiment to the seventh embodiment. However, the number of common channels may be four or more than four.

In the eighth embodiment, the return channel of the first common channel set, the supply channel of the first common channel set, the supply channel of the second common channel set, and the return channel of the second common channel set are arranged in order from the one arrangement direction (leftward direction in FIG. 13) to the other arrangement direction (rightward direction in FIG. 13). However, the arrangement of the return channels and the supply channels is not restricted such arrangement. An order of arrangement of the supply channels and the return channel of the first common channel set and the supply channel and the return channel of the second common channel set is arbitrary. For instance, the supply channels and the return channels may be arranged in order of the return channel of the first common channel set, the supply channel of the first common channel set, the return channel of the second common channel set, and the supply channel of the second common channel set from the one arrangement direction to the other arrangement direction. The supply channels and the return channels may be arranged in order of the supply channel of the first common channel set, the return channel of the first common channel set, the supply channel of the second common channel set, and the return channel of the second common channel set from the one arrangement direction to the other arrangement direction. Alternatively, the supply channels and the return channels may be arranged in order of the supply channel of the first common channel set, the return channel of the first common channel set, the return channel of the second common channel set, and the supply channel of the second common channel set from the one arrangement direction to the other arrangement direction.

A size and position of supply ports and discharge ports are not restricted in particular. For instance, in the embodiments described above, the area of the supply port or the area of the discharge port of the third common channel is larger than the area of the discharge port or the area of the supply port of the first common channel and the second common channel. However, the area of the supply ports and the discharge ports of the third common channel, the first common channel, and the second common channel may be mutually same.

The number of nozzles in the individual channels is either one or two in the embodiments described above. However, the number of nozzles in the individual channel may be three or more than three.

The nozzle may be arranged at a position other than the center of the communicating channel in the communicating direction.

The number of pressure chambers in the individual channel may be three or more than three.

The interval in the extending direction between the one end connected to the first common channel of the first individual channel and the other end connected to the third common channel of the first individual channel and the interval in the extending direction between the one end connected to the third common channel of the second individual channel and the other end connected to the second common channel of the second individual channel may differ mutually.

The angle of the acute angle side of the communicating direction of a certain first individual channel with respect to the extending direction and the angle of the acute angle side of the communicating direction of a certain second individual channel may differ mutually. Moreover the angle may be 60 degrees or more than 60 degrees.

The actuator is not restricted to an actuator of a piezoelectric type in which a piezoelectric element is used, and may be an actuator of other type (such as a thermal type in which a heating element is used or an electrostatic type in which static electricity is used).

The head is not restricted to be of a line type, and may be of a serial type (a type in which liquid is jetted onto a jetting target from nozzles while moving in a scanning direction which is parallel to the paper width direction).

For instance, in FIG. 2, in a case that the head 1 is of serial type, the first individual channel 20*a* is positioned downstream of the supply channel 33 in a scanning direction (in other words, upstream in a relative movement direction of the paper P relative to the head 1, where the paper P is a jetting target), and the second individual channel 20*b* is positioned upstream of the supply channel 33 in the scanning direction (downstream in the relative movement direction), when the actuator belonging to the first individual channel 20*a* is driven at the specified timing, the ink jetted from the nozzle 21 of the first individual channel 20*a* flies downstream in the scanning direction due to an effect of flow of ink from the supply channel 33 toward the return channel 31 through the first individual channel 20*a*, and lands at a position downstream of the desired position in the scanning direction. Therefore, in this case, by driving the actuator 12*x* belonging to the first individual channel 20*a* before the specified timing, the landing position of the ink jetted from the nozzle 21 of the first individual channel 20*a* is corrected to a position upstream in the scanning direction. Moreover, in this case, when the actuator 12*x* belonging to the second individual channel 20*b* is driven at the specified timing, the ink jetted from the nozzle 21 of the second individual channel 20*b* flies upstream in the scanning direction due to an effect of the flow of the ink from the supply channel 33 to the return channel 32 through the second individual channel 20*b*, and lands at a position upstream of the desired position in the scanning direction. Therefore, in this case, by driving the actuator 12*x* belonging to the second individual channel 20*b* after the specified timing, the landing position of the ink jetted from the nozzle 21 of the second individual channel 20*b* is corrected to a position downstream in the scanning direction.

The jetting target is not limited to the paper, and may be a cloth, a substrate, or the like.

The liquid jetted from the nozzle is not restricted to ink, and may be an arbitrary liquid (such as a treatment liquid for agglutinating or precipitating a component in ink).

The present teaching is not restricted to printer, and is also applicable to devices such as a facsimile, a copy machine, and a multifunction device. Moreover, the present teaching is also applicable to liquid jetting apparatuses that are used for application other than recording of an image (such as a liquid jetting apparatus which forms an electroconductive pattern by jetting an electroconductive liquid on a substrate).

What is claimed is:

1. A liquid jetting head having a surface in which nozzles are open, comprising:

individual channels;

a first common channel and a second common channel being return channels through which liquid is returned from the individual channels to a storage chamber configured to store the liquid; and a third common channel being a supply channel through which the liquid is supplied from the storage chamber to the individual channels, wherein the first common channel, the second common channel, and the third common channel are arranged in an arrangement direction, which is parallel to the surface, the third common channel is arranged between the first common channel and the second common channel in the arrangement direction, and extends in an extending direction which is parallel to the surface and orthogonal to the arrangement direction, the individual channels include: first individual channels which connect the first common channel and the third common channel; and second individual channels which connect the second common channel and the third common channel, each of the individual channels includes;

a nozzle included in the nozzles; and a communicating channel, the communicating channel running directly above the nozzle and being extended from the third common channel in a communication direction, which is parallel to the surface and intersects with the arrangement direction and the extending direction, the communicating direction of a certain first individual channel included in the first individual channels and the communicating direction of a certain second individual channel included in the second individual channels are both inclined with respect to the extending direction, and have vectors toward one side in the extending direction, the nozzle in the certain first individual channel and the nozzle in the certain second individual channel are adjacent to one another in relation to the extending direction, and the communicating direction of the certain first individual channel intersects with the extending direction such that an acute angle is formed by the communicating direction of the certain first individual channel and the extending direction on the one side in the extending direction, and the communicating direction of the certain second individual channel intersects with the extending direction such that an acute angle is formed by the communicating direction of the certain second individual channel and the extending direction on the one side in the extending direction.

2. The liquid jetting head according to claim 1, wherein the communicating direction of each of the first individual channels and the communicating direction of each of the second individual channels are both inclined with respect to the extending direction, and have the vectors toward the one side in the extending direction, and the third common channel has a supply port, through which the liquid is supplied to the third common channel, at an end portion on the one side in the extending direction.

3. The liquid jetting head according to claim 2, wherein the first common channel has a first discharge port, through which the liquid is discharged from the first common channel, at an end portion on the other side in the extending direction.

4. The liquid jetting head according to claim 3, wherein the second common channel has a second discharge port, through which the liquid is discharged from the second common channel, at an end portion on the other side in the extending direction.

5. A liquid jetting head having a surface in which nozzles are open, comprising:

individual channels;

a first common channel and a second common channel being supply channels through which liquid is supplied to the individual channels from a storage chamber configured to store the liquid; and a third common channel being a return channel through which the liquid is returned from the individual channels to the storage chamber, wherein the first common channel, the second common channel, and the third common channel are arranged in an arrangement direction, which is parallel to the surface, the third common channel is arranged between the first common channel and the second common channel in the arrangement direction, and extends in an extending direction orthogonal to the arrangement direction, the individual channels include: first individual channels which connect the first common channel and the third common channel; and second individual channels which connect the second common channel and the third common channel, each of the individual channels includes:

a nozzle included in the nozzles; and a communicating channel, the communicating channel running directly above the nozzle and being extended from the third common channel in a communicating direction, which is parallel to the surface and intersects with the arrangement direction and the extending direction, the communicating direction of a certain first individual channel included in the first individual channels and the communicating direction of a certain second individual channel included in the second individual channels are both inclined with respect to the extending direction, and have vectors toward one side in the extending direction, the nozzle in the certain first individual channel and the nozzle in the certain second individual channel are adjacent to one another in relation to the extending direction the communicating direction of the certain first individual channel intersects with the extending direction such that an acute angle is formed by the communicating direction of the certain first individual channel and the extending direction on the one side in the extending direction, and the communicating direction of the certain second individual channel intersects with the extending direction such that an acute angle is formed by the communicating direction of the certain second individual channel and the extending direction on the one side in the extending direction.

6. The liquid jetting head according to claim 5, wherein the communicating direction of each of the first individual channels and the communicating direction of each of the second individual channels are both inclined with respect to the extending direction, and have the vectors toward the one side in the extending direction, and the third common channel has a discharge port, through which the liquid is discharged from the third common channel, at an end portion on the one side in the extending direction.

7. The liquid jetting head according to claim 6, wherein the first common channel has a first supply port, through which the liquid is supplied to the first common channel, at an end portion on the other side in the extending direction.

8. The liquid jetting head according to claim 7, wherein the second common channel has a second supply port, through which the liquid is supplied to the second common channel, at an end portion on the other side in the extending direction.

9. The liquid jetting head according to claim 1, wherein each of the first individual channels has a first distance, in relation to the extending direction, between one end connected to the first common channel and the other end connected to the third common channel, each of the second individual channels has a second distance, in relation to the extending direction, between one end connected to the third common channel and the other end connected to the second common channel, and the first distance is equal to the second distance.

10. The liquid jetting head according to claim 9, wherein the nozzle is arranged at a center of the communicating channel in the communicating direction.

11. The liquid jetting head according to claim 1, wherein each of the individual channels includes: pressure chambers communicating with the nozzle; and connecting channels connecting each of the pressure chambers and the communicating channel.

12. The liquid jetting head according to claim 5, wherein each of the individual channels has one pressure chamber communicating with the nozzle.

13. The liquid jetting head according to claim 12, wherein the one pressure chamber is the communicating channel.

14. The liquid jetting head according to claim 1, wherein each of the communicating channel of the certain first individual channel and the communicating channel of the certain second individual channel has an asymmetrical shape with respect to a first center line, the first center line being extended in a direction, which is parallel to the surface and orthogonal to the communicating direction and passing through a center of the communicating channel in the communicating direction, and the communicating channel of the certain first individual channel and the communicating channel of the certain second individual channel have a mutually symmetrical shape with respect to a second center line, the second center line being parallel to the surface, extended in the extending direction and passing through a center of the third common channel in the arrangement direction.

15. The liquid jetting head according to claim 1, wherein the acute angle formed between the communicating direction of the certain first individual channel and the extending direction is less than 60 degrees, and the acute angle between the communicating direction of the certain second individual channel and the extending direction is less than 60 degrees.

16. The liquid jetting head according to claim 1, wherein the acute angle between the communicating direction of the certain first individual channel and the extending direction is the same as the acute angle between the communicating direction of the certain second individual channel and the extending direction.

17. The liquid jetting head according to claim 1, wherein an angle between the communicating direction of the certain first individual channel and a flow direction is smaller than an angle between the communicating direction of the certain second individual channel and the flow direction, the flow direction being a direction along the extending direction and in which the liquid flows through the third common channel, and a cross-sectional area of the communicating channel in the certain first individual channel is larger than a cross-sectional area of the communicating channel in the certain second individual channel.

18. A liquid jetting head having a surface in which nozzles are open, comprising:

individual channels;

a first common channel set including: a first supply channel through which liquid is supplied from a first storage chamber configured to store the liquid to the individual channels; and a first return channel through which the liquid is returned from the individual channels to the first storage chamber; and a second common channel set including a second supply channel through which liquid is supplied from a second storage chamber configured to store the liquid to the individual channels; and a second return channel through which the liquid is returned from the individual channels to the second storage chamber, wherein the first common channel set and the second common channel set are arranged in an arrangement direction which is parallel to the surface, in each of the first common channel set and the second common channel set, the respective supply channel and the respective return channel are arranged in the arrangement direction, and each of the respective supply channel and the respective return channel extends in an extending direction, which is parallel to the surface and orthogonal to the arrangement direction, the individual channels include: first individual channels which connect the first supply channel and the first return channel of the first common channel set; and second individual channels which connect the second supply channel and the second return channel of the second common channel set, and each of the individual channels includes:

a nozzle included in the nozzles; and a communicating channel, the communicating channel running directly above the nozzle and being extended from the respective supply channel to the respective return channel in a communicating direction, which is parallel to the surface and intersects with the arrangement direction and the extending direction, the communicating direction of a certain first individual channel included in the first individual channels and the communicating direction of a certain second individual channel included in the second individual channels are both inclined with respect to the extending direction, and have vectors toward one side in the extending direction, the nozzle in the certain first individual channel and the nozzle in the certain second individual channel are adjacent to one another in relation to the extending direction, and the communicating direction of the certain first individual channel intersects with the extending direction such that an acute angle is formed by the communicating direction of the certain first individual channel and the extending direction on the one side in the extending direction, and the communicating direction of the certain second individual channel intersects with the extending direction such that an acute angle is formed by the communicating direction of the certain second individual channel and the extending direction on the one side in the extending direction.

19. A liquid jetting apparatus, comprising:

a liquid jetting head having a surface in which nozzles are open; and a controller, wherein the liquid jetting head includes:

individual channels each including a nozzle included in the nozzles, a communicating channel running directly above the nozzle, and at least one pressure chamber which communicates with the nozzle;

actuators each facing the pressure chamber of one of the individual channels;

a first common channel and a second common channel being return channels through which liquid is returned from the individual channels to a storage chamber configured to store the liquid; and a third common channel being a supply channel through which the liquid is supplied from the storage chamber to the individual channels, the first common channel, the second common channel, and the third common channel are arranged in an arrangement direction, which is parallel to the surface, the third common channel is arranged between the first common channel and the second common channel in the arrangement direction, and extends in an extending direction which is parallel to the surface and orthogonal to the arrangement direction the individual channels include: first individual channels which connect the first common channel and the third common channel; and second individual channels which connect the second common channel and the third common channel, the communicating channel of each of the individual channels extends from the third common channel in a communicating direction, which is parallel to the surface and intersects with the arrangement direction and the extending direction, the communicating direction of a certain first individual channel included in the first individual channels and the communicating direction of a certain second individual channel included in the second individual channels are both inclined with respect to the extending direction, and have vectors toward one side in the extending direction, the nozzle in the certain first individual channel and the nozzle in the certain second individual channel are adjacent to one another in relation to the extending direction, the communicating direction of the certain first individual channel intersects with the extending direction such that an acute angle is formed by the communicating direction of the certain first individual channel and the extending direction on the one side in the extending direction, the communicating direction of the certain second individual channel intersects with the extending direction such that an acute angle is formed by the communicating direction of the certain second individual channel and the extending direction on the one side in the extending direction, the first individual channels are positioned upstream of the third common channel in a relative movement direction of a jetting target relative to the liquid jetting head, the second individual channels are positioned downstream of the third common channel in the relative movement direction, the actuators include: first actuators each facing the pressure chamber of one of the first individual channels; and second actuators each facing the pressure chamber of one of the second individual channels, and the controller is configured to:

drive the first actuators before a specified timing, the specified timing being a timing at which the actuators are driven in a case that the communicating direction is parallel to the extending direction; and drive the second actuators after the specified timing.

* * * * *